US009826864B2

(12) United States Patent
Bunnell

(10) Patent No.: US 9,826,864 B2
(45) Date of Patent: Nov. 28, 2017

(54) PRODUCT ROLL CUTTING AND HANDLING MECHANISM AND METHOD

(76) Inventor: Donald K. Bunnell, St. Joseph, MI (US)

( * ) Notice: Subject to any disclaimer, the term of this patent is extended or adjusted under 35 U.S.C. 154(b) by 732 days.

(21) Appl. No.: 13/257,252

(22) PCT Filed: Nov. 8, 2010

(86) PCT No.: PCT/US2010/055792

§ 371 (c)(1),
(2), (4) Date: Jun. 13, 2012

(87) PCT Pub. No.: WO2012/064320

PCT Pub. Date: May 18, 2012

(65) Prior Publication Data

US 2013/0213203 A1 Aug. 22, 2013

(51) Int. Cl.

| | |
|---|---|
| ***B26D 5/28*** | (2006.01) |
| ***A47K 10/36*** | (2006.01) |
| ***B26D 1/20*** | (2006.01) |
| *B26D 5/00* | (2006.01) |

(52) U.S. Cl.

CPC ..... *A47K 10/3606* (2013.01); *A47K 10/36* (2013.01); *A47K 10/3612* (2013.01); *B26D 1/205* (2013.01); *B26D 5/00* (2013.01); *Y10T 83/4463* (2015.04)

(58) Field of Classification Search

CPC ..... Y10T 83/4483; Y10T 83/8822; Y10T 83/4463; A47K 10/36; A47K 10/3606; B26D 1/205

USPC ..... 83/614, 452, 455

See application file for complete search history.

(56) References Cited

U.S. PATENT DOCUMENTS

| | | | | |
|---|---|---|---|---|
| 3,821,915 A * | 7/1974 | Larrable | B26D 1/185 83/174 |
| 6,468,197 B1 * | 10/2002 | Lencoski et al. | 493/464 |
| 6,994,408 B1 * | 2/2006 | Bunnell | 312/34.8 |

* cited by examiner

*Primary Examiner* — Kenneth E. Peterson
*Assistant Examiner* — Samuel A Davies

(57) ABSTRACT

A hands-free paper product dispenser has three separate IR emitter and sensor circuits, two controlling the length and/or number of sheets of paper cut and dispensed, and the third used both to safety interlock the cutter mechanism and to control retention of each cut sheet by the dispenser until removed from the dispenser by a user. A novel cutting mechanism and associated upper and lower pinch plates are employed to both hold the paper during cutting and assure a straight and unfrayed cut.

7 Claims, 25 Drawing Sheets

Section A-A'

PRODUCT ROLL CUTTING AND HANDLING MECHANISM AND METHOD

BACKGROUND OF INVENTION

Many consumable products are manufactured in the form of spirally-wound rolls, e.g., paper towels and gift wrap. While these products can be unwound from the roll entirely by hand, there are a number of devices in the prior art to aid in dispensing product from the roll. These range from simple support of the roll, such as a single upright spindle upon which the axis of the roll is vertically installed, to cabinets into which a product roll is placed and which have mechanisms for dispensing product.

For simplicity of further discussion, and because the most common product roll dispensed is paper or similar nonwoven web material, the terms "paper," "paper towel" and "paper towel roll" will be used hereinafter instead of "product" and "product roll." However, it should be understood that the present invention can be adapted to virtually any spiral-wound sheet product.

U.S. patents to Byrd, et al., specifically U.S. Pat. Nos. 5,772,291, 6,105,898 and 6,293,486, disclose electrically-driven paper dispensers incorporating a photocell which causes a motor to unroll paper when an object (such as human hand) blocks light entering it. One patent (U.S. Pat. No. 4,738,176) combines electrically-actuated unwinding with electrically-actuated cutting; a bi-directional motor moves the paper when turning in one direction and cuts it when turning in the other direction.

However, until the issue of U.S. Pat. No. 6,994,408 to the present inventor, the prior art did not provide the user separate hands-free control of the amount of paper dispensed and the timing of cutting the paper off. Another problem with the art prior to U.S. Pat. No. 6,994,408 was that either the paper was released before the user is ready to take it, or the user had to pull so hard to take the paper from the machine.

Yet another problem with the art prior to U.S. Pat. No. 6,994,408 was that many dispensers were designed to handle only one specific paper, e.g., thin, low-cost hand towels. If other paper grades were used in these types of dispensers, feed and cutting problems may have resulted.

Yet another problem with dispensers of the art prior to U.S. Pat. No. 6,994,408 was that parts driven at high speed were stopped by surfaces, such as bumpers, in the machine, which led to excessive noise and impact wear. There was also room for simplifying mechanisms for the holding of the paper by machine parts during and after cutting, which were addressed by U.S. Pat. No. 6,994,408 and are improved by the present invention.

Other needs addressed by the present invention are reduction in operating noise and vibration, and reduction in the number of, and increase and simplicity of, parts necessary to move, cut, and hold the roll product.

The present invention also adds safety features, and embodiments providing novel dispensing capabilities.

SUMMARY OF INVENTION

The invention described here is a novel cutting and handling mechanism for electric-powered dispensers of spirally-wound materials such as paper towels, which uses novel mechanics and electronic circuits to position, unroll, and cut towel material, and to interlock those operations. It also uses novel structures to cut, guide, and hold material.

Other embodiments add dispensing capabilities, both preset and user-variable, cabinet structures, and installation options.

DETAILED DESCRIPTION

Figure 1:
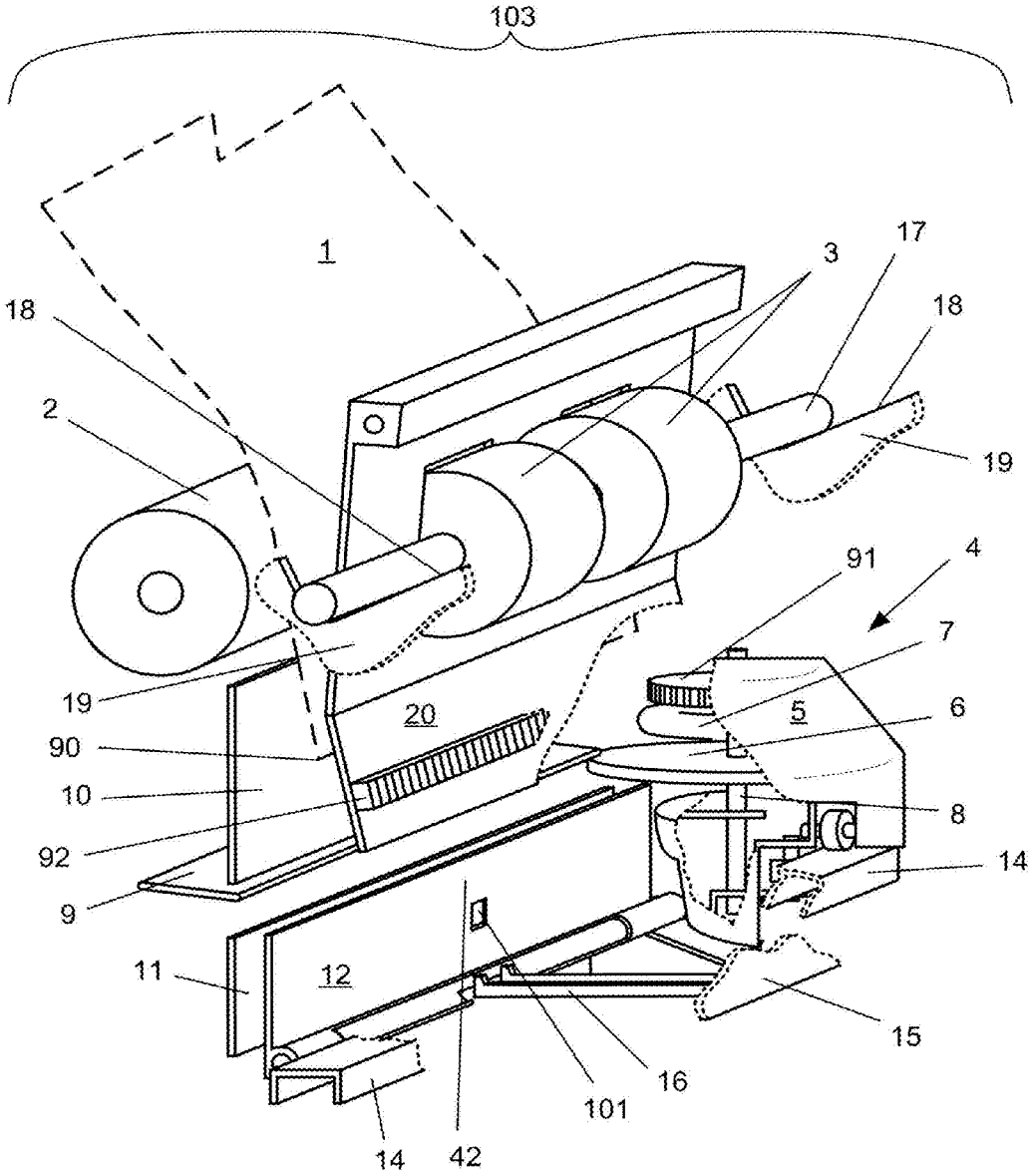
FIG. 1 is a perspective view of a first, preferred, embodiment of present invention from the upper left front.
Figure 2:
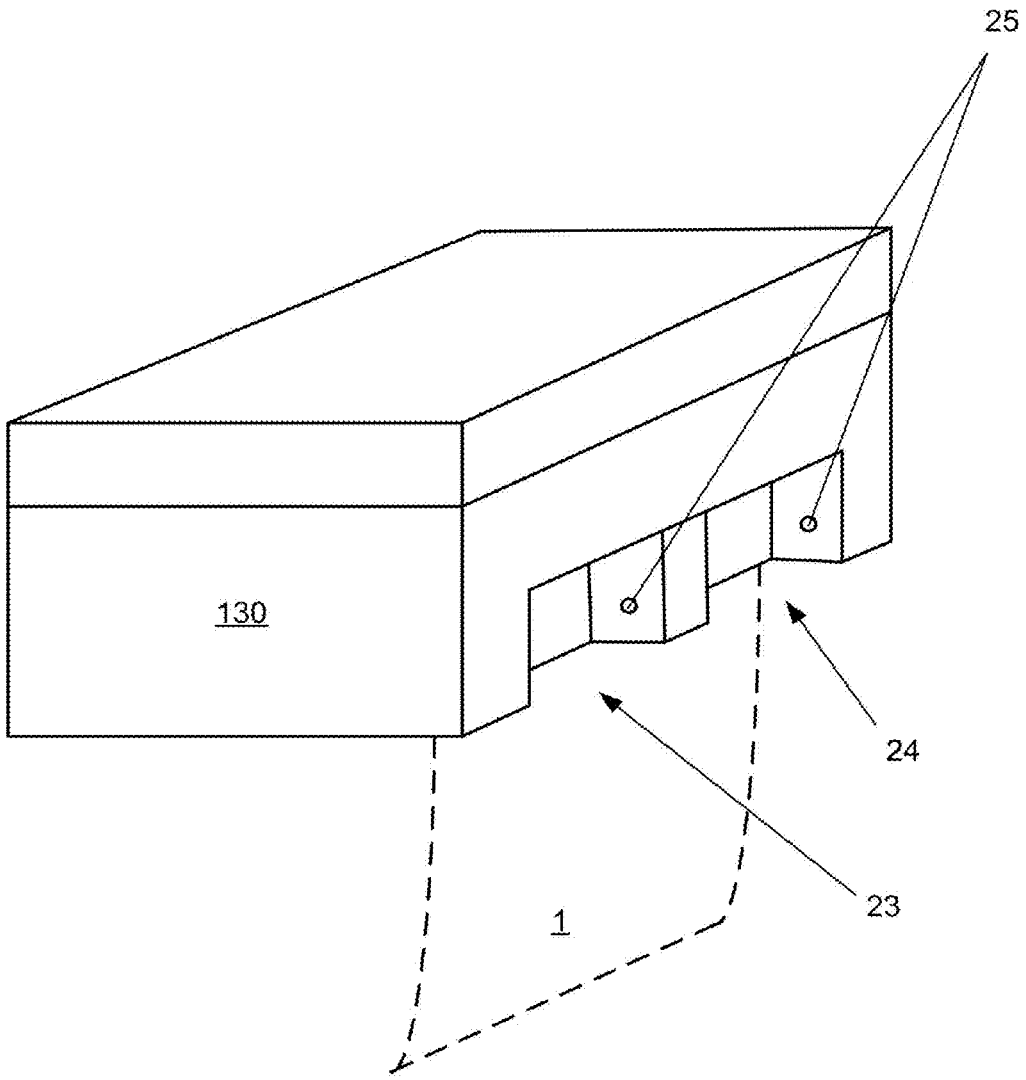
FIG. 2 is a perspective view of a second embodiment of the present invention in which the preferred embodiment is installed in a generic cabinet.

Referring now to the attached drawings, in which like features are represented by like reference characters in each of the drawings, FIG. 1 is a perspective view of the preferred embodiment of the present invention from the upper left front. The invention is a novel cutting and handling mechanism for electric-powered dispensers of spirally-wound materials such as paper towels, in which the leading end 90 of a wound strip of paper 1 (shown in large dashed lines to indicate environmental structure) is unwound to a user-selected length past a horizontal stationary paper cutting blade 9, whence it is cut horizontally at a user-selected time and held gently between a lower backing plate 11 and a lower pinch plate 12 until extraction by the user. The preferred embodiment of the invention is assembled as a module 103 comprising all of the parts described and illustrated below unless otherwise excluded. Construction of the invention in modular form enables the invention to be housed in a variety of cabinets or drawers, and enables each module to be tested before it is incorporated into a final product. The module 103 is typically to be housed in a cabinet (e.g., such as depicted in FIG. 2) into which a product roll such as a roll of paper towels may be loaded. It should be understood, while looking at this and the following figures, that unless otherwise indicated, the stationary parts herein described are fixed to a common support structure which may in turn be enclosed in a cabinet.

It should also be understood that the description and scope of this invention is meant to include its mirror image, i.e., that left and right may be interchanged throughout.

The leading portion of paper 1 from such a product roll is shown having been fed manually into a nip (better visible in the following side views, see FIG. 3) between a drive roller 2 and idler rollers 3. One drive roller and two idler rollers are depicted here, but the scope of the description and claims of the invention is meant to include any number of drive or idler rollers on common axes.

The idler rollers 3 press the paper 1 against the drive roller 2 under their own weight and that of idler shaft 17, bearing against inclines 18 on cutaways of shaft support structure 19. A cutter carousel 4 is shown at its home position at the far right, with its case 5 cut away to show a circular paper cutting blade 6, a pinion 91, and a rubber o-ring 7 mounted on a cutter dowel pin 8.

A substantially vertical upper pinch plate 20 (cutaway to show other parts), a cutaway portion of a rack 92 fixed to the upper pinch plate 20, and an upper backing plate 10 are also shown, the function of which are explained further below.

The carousel 4 is moved horizontally left and right by a belt (not shown) driven by an electric cut motor 200 as is known in the art. Novel to the art, however, is that the circuitry controlling the horizontal positioning of the carousel 4 is designed in such a way that when voltage is initially applied to the invention ("power-up"), the carousel is moved to this home position in a manner dependent on its initial position before power-up (see FIGS. 19 and 20).

This view also shows a lower pinch plate opening 101 near the central portion 42 of the lower pinch plate 12, the function of which will be explained below in FIG. 6.

Also visible in cutaways in this view are the left and right ends of carousel rail 14 and a portion of the common support structure 15, from which lower pinch plate catch arm 16 extends rearward.

FIG. 2 is a perspective view from the upper left front of a generic cabinet 130 into which a module 103 of the preferred embodiment of the present invention (not visible in this view) has been installed. (The preferred embodiment combined with a cabinet 130 constitutes a second embodiment, as discussed more fully beginning with FIG. 14.) It shows a left recess 23 and a right recess 24, across each of which is projected an electromagnetic beam (e.g., infrared (IR) light) through four lenses 25 (two of which are on the opposite sides of the recesses and are therefore not visible in this view).

Paper 1 has been advanced downward by a user breaking an electromagnetic beam (not visible) projected across the right recess 24 by putting his/her hand in the right recess 24 for an amount of time necessary to cause a desired length of paper 1 to appear below the cabinet 130. As explained in greater detail below, the paper 1 is cut by a user breaking a second electromagnetic beam (not visible) projected across the left recess 23 by putting his/her hand in the left recess 23 for any amount of time, however short, as long as the beam is broken.

Figure 3:
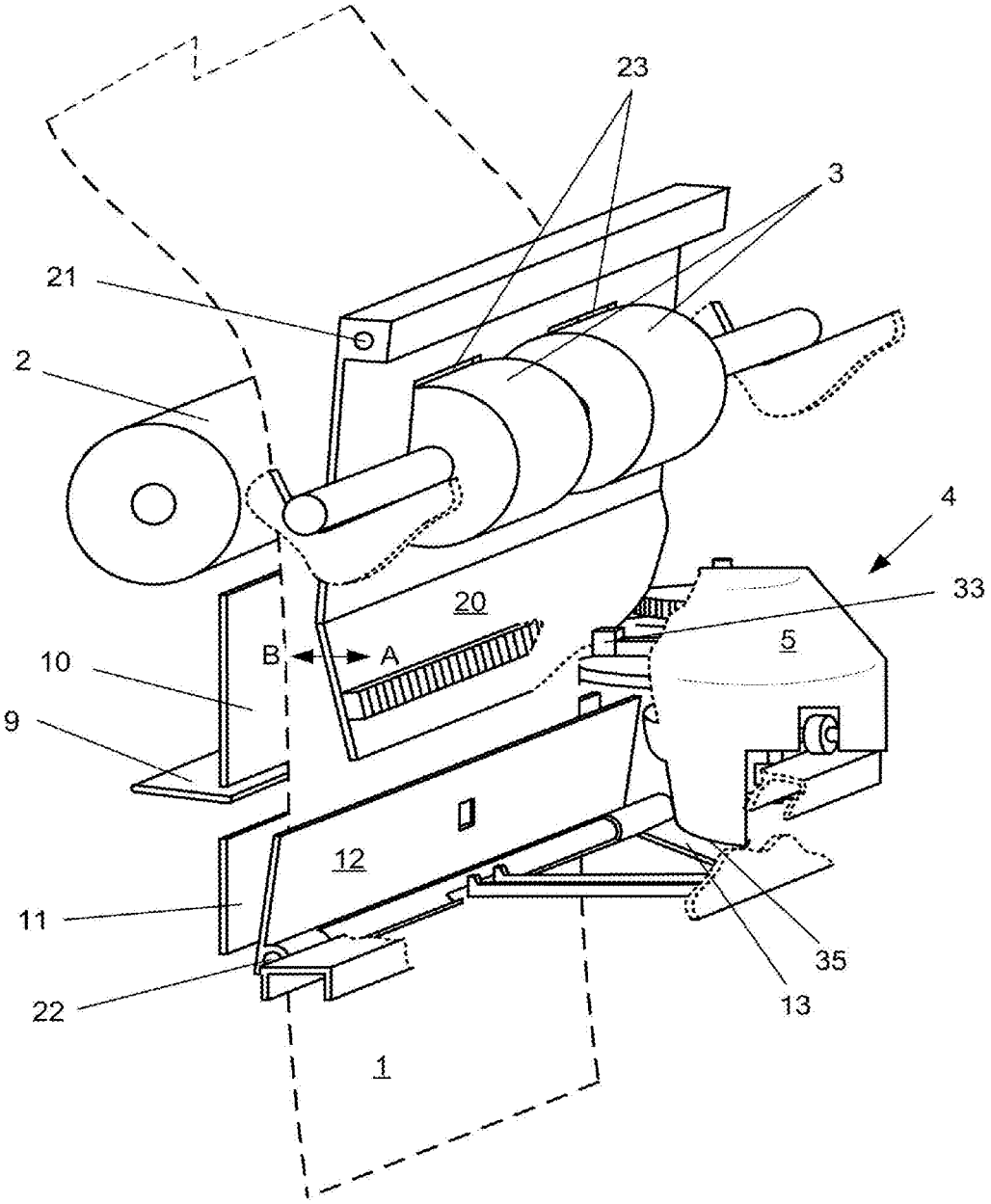
FIG. 3 is another perspective view of the preferred embodiment from the upper left front after paper has been advanced.

FIG. 3 is another perspective view of the preferred embodiment from the upper left front of the invention. In this view, the paper 1 has been advanced by drive roller 2 to an arbitrary length below the invention. A drive motor 30 (see FIG. 4) runs as long as the beam is broken and stops when the user's hand is withdrawn. It should be noted that the stationary paper cutting blade 9, the upper backing plate 10 and the lower backing plate 11 are fixed to stationary modular components (not shown for clarity) of the invention. The upper pinch plate 20 and the lower pinch plate 12, however, are suspended rotationally about the upper pinch plate dowel pins 21 (only left pin is visible in this view) and the lower pinch plate dowel pins 22 (only left pin is visible in this view). This allows the upper and lower pinch plates to move forwardly (arrow A) and backwardly (arrow B) about horizontal axes passing through the dowel pins, as further described below.

This figure illustrates some additional functions performed by the carousel 4 in its home position. While in this position, both the upper pinch plate 20 and the lower pinch plate 12 are opened as far forwardly as they will go relative to the upper backing plate 10 and the lower backing plate 11, respectively, so as to provide the widest possible opening for the paper 1 to advance through. The upper pinch plate tends to rotate forwardly (counterclockwise about the upper pinch plate dowel pins 21 in this view) due to its own weight distribution, and its forward travel is thus at a maximum, limited only by an abutment 33 fixed to the carousel 4. Similarly, the lower pinch plate 12, which is normally biased rearwardly (counterclockwise about the lower pinch plate dowel pins 22 in this view) by a spring (not shown) is held forwardly to the maximum extent, against the spring bias, by a lower pinch plate release foot 35 fixed to the bottom of the case 5 of the carousel 4. When the carousel 4 is in its home position, the release foot 35 presses downwardly on a lower pinch plate release pad 13 fixed to the right end of the lower pinch plate 12, which rotates the lower pinch plate 12 clockwise about the lower pinch plate dowel pins 22.

In this view it can also be seen that idler rollers 3 come into contact with either paper 1 or drive roller 2 through rectangular cutouts 23 in the upper pinch plate 20. Thus the upper pinch plate 20 does not interfere with the rotation of the idler rollers 3.

Figure 4:
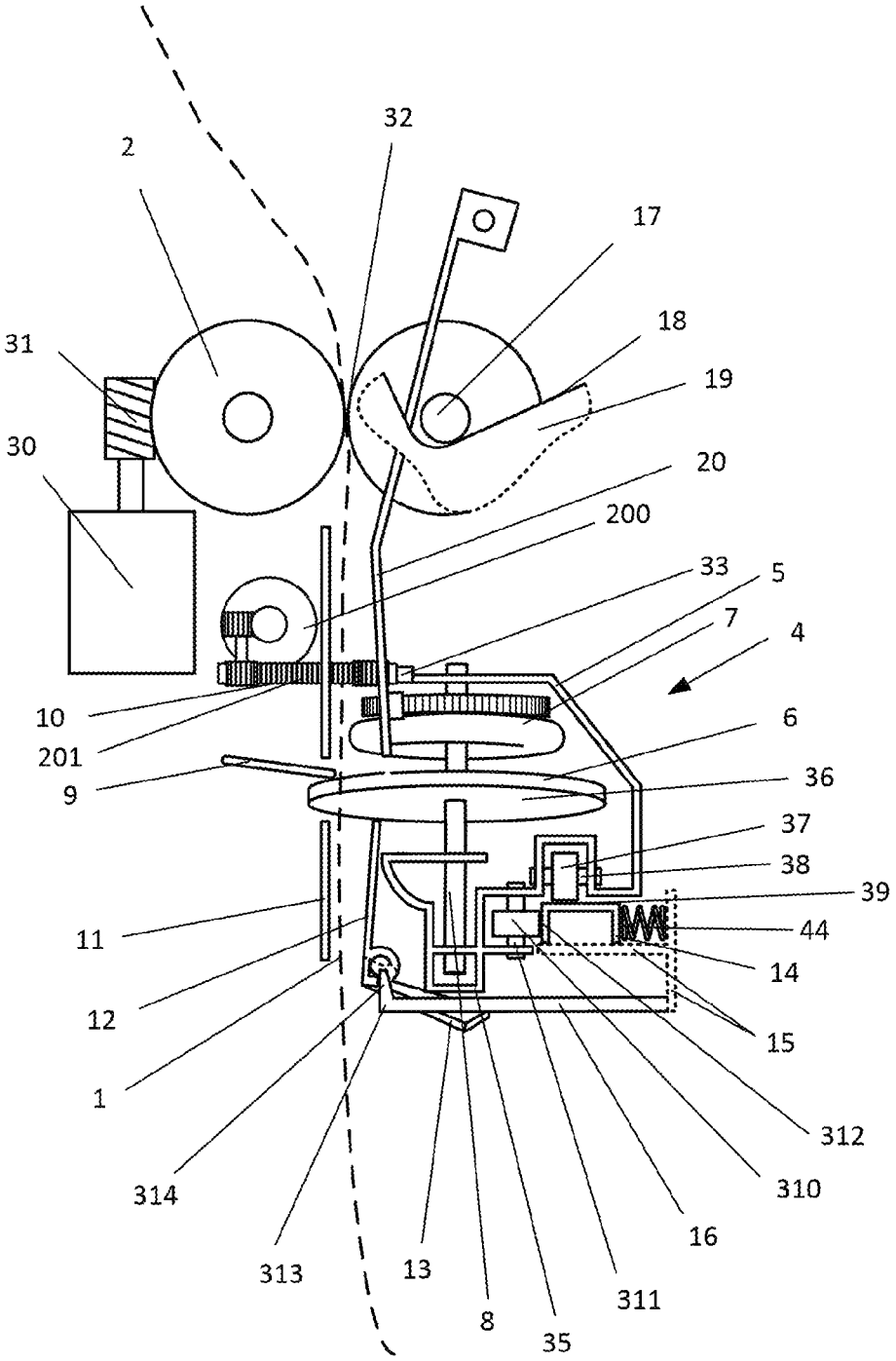
FIG. 4 is a left side view of the preferred embodiment in the same state as in FIG. 3.

FIG. 4 is a left side view of the preferred embodiment of the present invention in the same state as in FIG. 3 (home position) showing the drive motor 30 and worm gear 31 engaged to drive roller 2, which has just advanced the paper 1 through nip 32 to a user-selected length. The upper pinch plate 20 is shown resting lightly against the carousel abutment 33, and the left end of the idler shaft 17 is shown as being supported rotatably on the left incline 18 on the left cutaway of the shaft support structure 19. (The right end of the idler shaft 17 is similarly supported by like parts at the other end of the shaft 17.)

Also notable in this view is that the circular paper cutting blade 6 is behind (in this view) the paper 1, and the rubber o-ring 7 is behind the upper pinch plate 20. Because the carousel 4 is in its home position, as explained below in more detail, and because of the positioning of the upper pinch plate 20 against the carousel abutment 33, the paper 1 is permitted to hang freely in the open space between the upper backing plate 10 and the upper pinch plate 20 and in the open space between the lower backing plate 11 and the lower pinch plate 12.

In the development of the present invention, it was discovered that optimal paper cutting action occurs when the plane of the circular paper cutting blade 6 and the axis of the cutter dowel pin 8 are tilted clockwise as viewed from the front of the invention by about 5 degrees (thus exposing the lower surface 36 of the circular paper cutting blade 6 to view as shown). It has also been found that cutting action is further enhanced by tilting the stationary paper cutting blade 9 downward toward the front of the invention (toward the right in this view) by about 5 degrees.

This figure also shows significant additional elements of the carousel 4 and their function. It can be seen in this view that carousel 4 is supported for horizontal travel left and right (out of and into the page in this view) from below by a carousel rail 14. The carousel 4 rides on the upper surface 39 of the carousel rail 14 by means of an upper guide wheel 37 rotating on the horizontal axis of an upper guide wheel dowel pin 38, and rides on the rear surface 312 of the carousel rail 14 by means of a lower guide wheel 310 rotating on the vertical axis of a lower guide wheel dowel pin 311. The carousel rail 14 is prevented by the support structure 15 from moving up or down at both ends, but is allowed to move backwards and forwards against the support structure 15 at both ends by rail springs 44 (only the left rail spring 44 is shown in this view).

Finally as to FIG. 4, note that the rearmost end 313 of catch arm 16 has upward-extending abutments 314 on it which are placed so as to engage and release the center of the lower pinch plate 12, under conditions explained in more detail further below.

Figure 5:
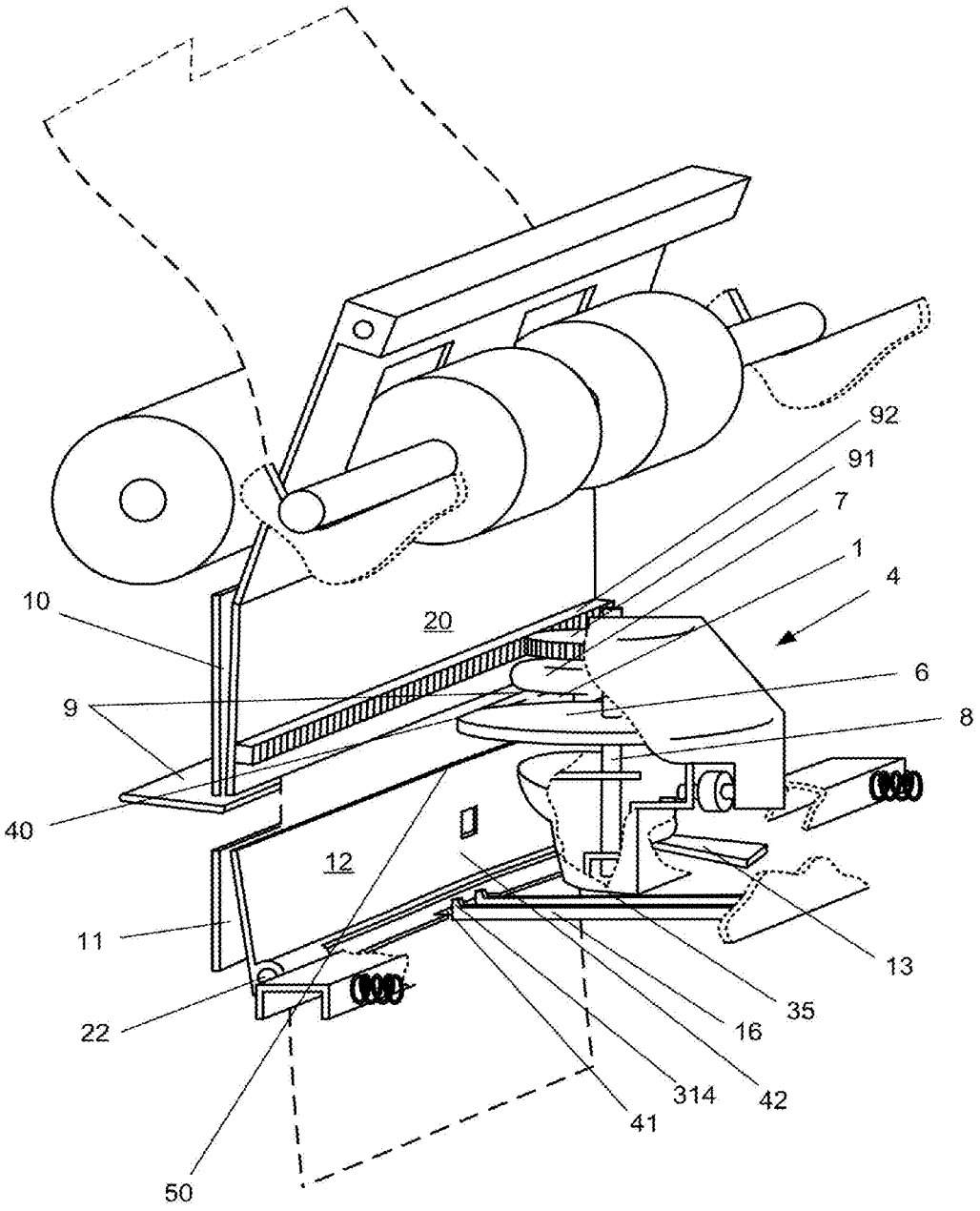
FIG. 5 is a perspective view from the upper left front of the preferred embodiment during the leftward pass of the cutting sequence.

FIG. 5 is a perspective view from the upper left front of the invention during the leftward pass of the cutting sequence. As the carousel 4 starts moving to the left, the rubber o-ring 7 contacts the upper pinch plate 20 before the circular paper cutting blade 6 begins to cut the paper 1. This is because of the diameters selected for the circular paper cutting blade 6 and the rubber o-ring 7, and the distance that the right hand edge of the paper 1 is positioned to the left of the right hand edges of the upper pinch plate 20 and the lower pinch plate 12. Thus, before any paper cutting takes place, the upper pinch plate 20 is pushed rearward by the rubber o-ring 7, pinching the paper 1 against the upper backing plate 10. Friction of the o-ring 7 against the upper pinch plate 20 also serves to drive the circular paper cutting blade 6 clockwise (as viewed from above) about the cutter dowel pin 8.

Optionally, a pinion 91 may be installed upon the cutter dowel pin 8, for the purpose of engaging a rack 92 fixed to the front side of the upper pinch plate 20 to provide positive forced rotation of the circular paper cutting blade about the cutter dowel pin 8.

Also occurring as the carousel 4 leaves its home position, the lower pinch plate release foot 35 moves leftwardly off of the lower pinch plate release pad 13, allowing the lower pinch plate 12 to rotate rearwardly, pinching the paper 1 against the lower backing plate 11. This upper and lower pinching of the paper prevents the paper from bunching as it is cut. Furthermore, because the rubber o-ring 7 is of smaller diameter than the circular paper cutting blade 6, the rearward edge 40 of the circular paper cutting blade 6 is forced to move rightward relative to the stationary paper cutting blade 9, which adds a rightward shear component to what would otherwise be a purely rearward shear component against the paper 1. These two effects produce an extremely clean cut and minimize the creation of paper dust.

Finally as to FIG. 5, note that because the lower pinch plate 12 has rotated to the rear (under the rearward bias of a spring, not shown) a notch 41 near the central portion 42 of the lower pinch plate 12 has rotated forwardly about the axis of the lower pinch plate dowel pin 22, against the upward-extending abutments 314 on the catch arm 16. The central portion 42 of the lower pinch plate 12 thus applies more pinching force against the paper 1 than is applied to the paper 1 by the remainder of the lower pinch plate 12 whenever the carousel 4 is not in its home position. Note the slight rearward bowing of the upper edge 50 produced by this effect.

Figure 6:
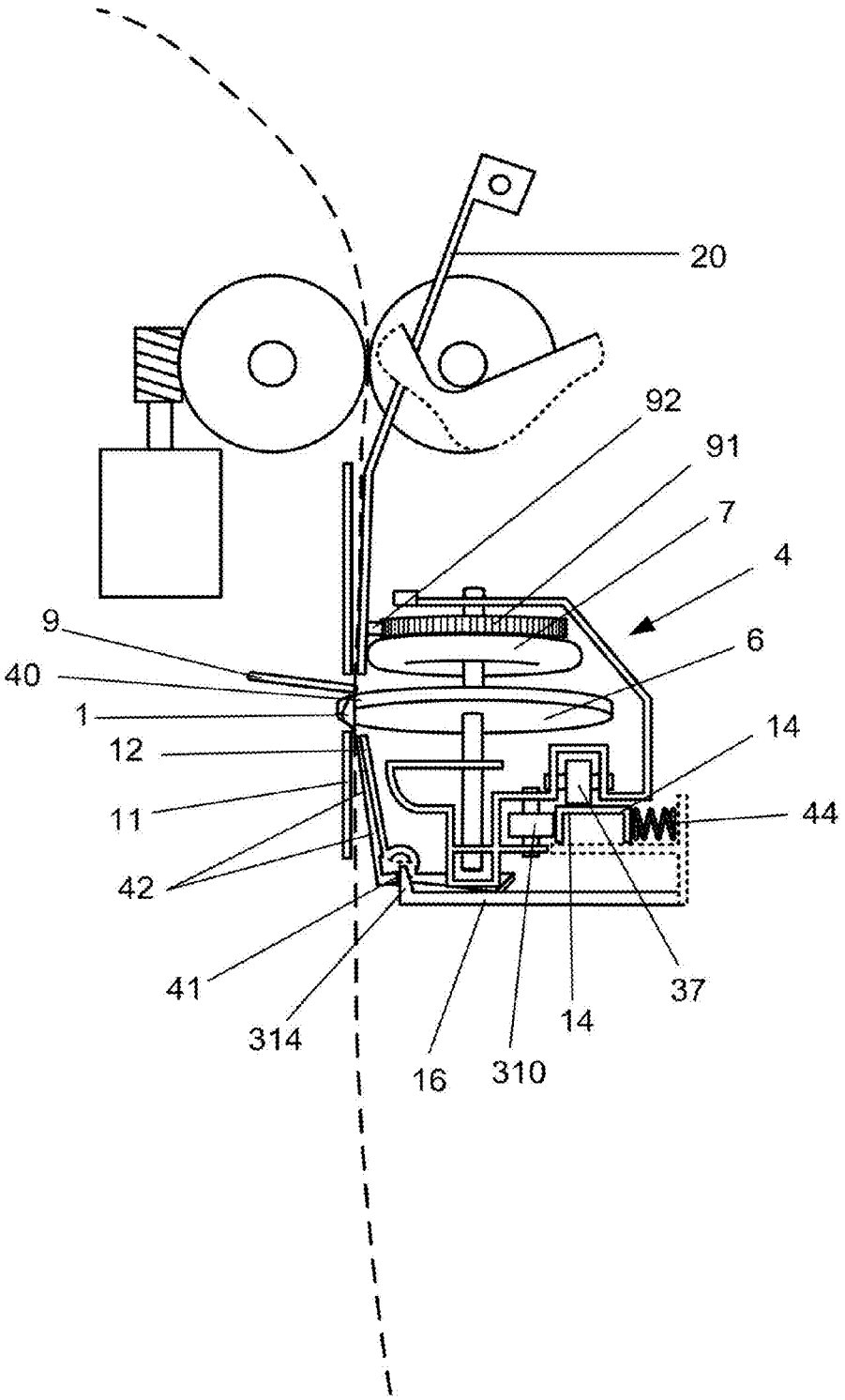
FIG. 6 is a left side view of the preferred embodiment in the same state as in FIG. 5.

FIG. 6 is a left side view of the preferred embodiment of the present invention in the same state as in FIG. 5. It shows a view of the lower pinch plate 12, cutaway to show again the bowing effect of the notch 41 pressing against the upward-extending abutments 314 on the catch arm 16. The purpose of holding the paper 1 against the lower backing plate 11 only at the central portion 42 constitutes a twofold improvement over the prior art: (a) the cut portion of the paper is more gently held at the center than if it is held by the entire width of the lower pinch plate 12, and thus may be removed by even less force than required by the prior art; and (b) by being held at the center, the cut paper is less likely to sag to one side or the other.

This view also shows that the carousel upper guide wheel 37 and the lower guide wheel 310 remain in contact with the midpoint of the carousel rail 14. The rail springs 44 assure that the o-ring 7 will contact the upper pinch plate firmly, and cause the carousel rail 14 to exert a rearward force on the lower guide wheel 310 at all horizontal locations of the carousel 4. This has the added beneficial effect of applying a clockwise (in this view) torque on the carousel 4 about the point of contact between the o-ring 7 and the upper pinch plate 20, causing the rearward edge 40 of the circular paper cutting blade 6 to press upwardly against the horizontal paper cutting blade 9. This further assures a clean cut.

The pinion 91 is also shown engaged to the rack 92 in this view.

Figure 7:
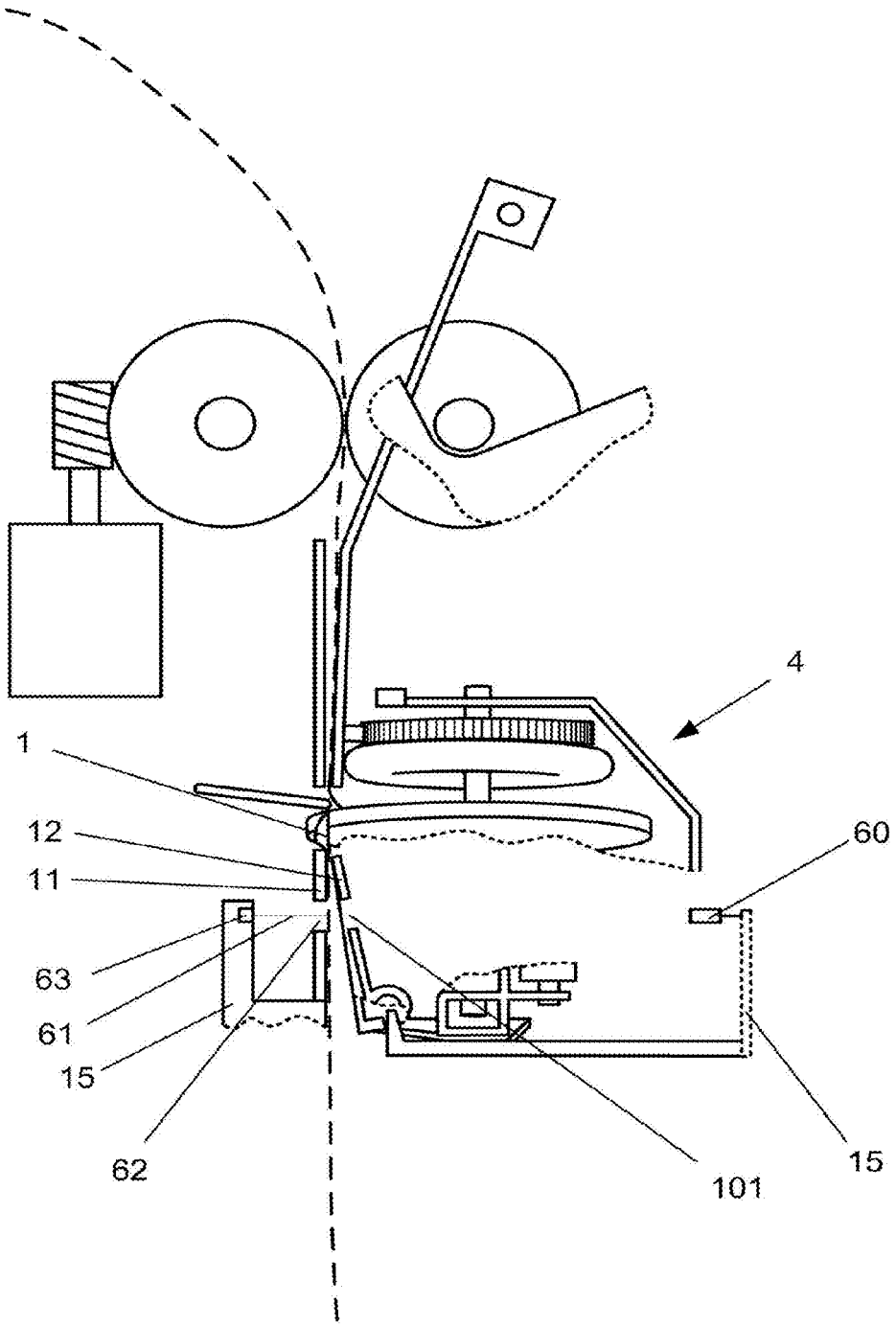
FIG. 7 is a left side view of the preferred embodiment in the same state as in FIG. 6 showing additional elements.

FIG. 7 is a left side view of the preferred embodiment of the present invention in the same state as in FIG. 6 showing additional elements. A portion of the carousel 4 has been cut away to show a control element for the lower pinch plate 12 and the carousel 4. It comprises an infrared (IR) light-emitting diode (LED) 63 fixed to the rear support structure 15 of the invention, emitting a beam of IR light 61 forward, a lower pinch plate opening 101, a lower backing plate opening 62, and an IR sensor 60 fixed to a front part of the support structure 15. At this time in the cutting cycle, namely during the leftward pass of the carousel 4 (toward the reader in this view) the lower pinch plate 12 is pressing the paper 1 against the lower backing plate 11. Thus the beam of IR light 61 is blocked temporarily by the paper 1 from striking the IR sensor 60.

Figure 8:
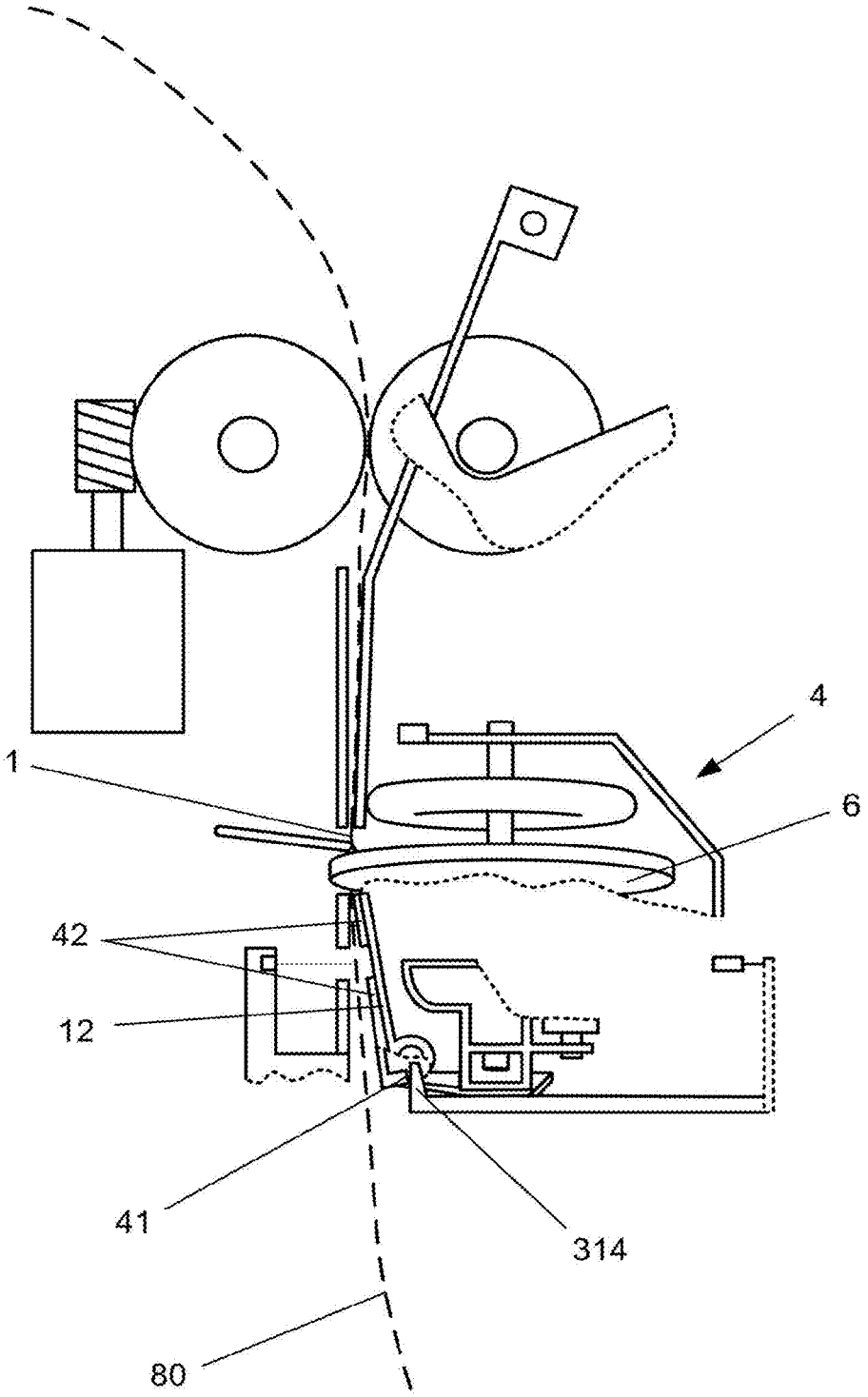
FIG. 8 is a left side view of the invention after the leftward pass of the cutting sequence.

FIG. 8 is a left side view of the invention after the leftward pass of the cutting sequence, at which time the carousel 4 is as far as it will go toward the reader in this view. Note that the paper 1 is now fully cut, producing a cut paper portion 80, both of which are now to the right of (behind in this view) the circular paper cutting blade 6. Note also that the central portion 42 of the lower pinch plate 12 is still being bowed against the cut paper portion 80 by the abutments 314 pressing rearwardly against the notch 41 in the lower pinch plate 12.

Figure 9:
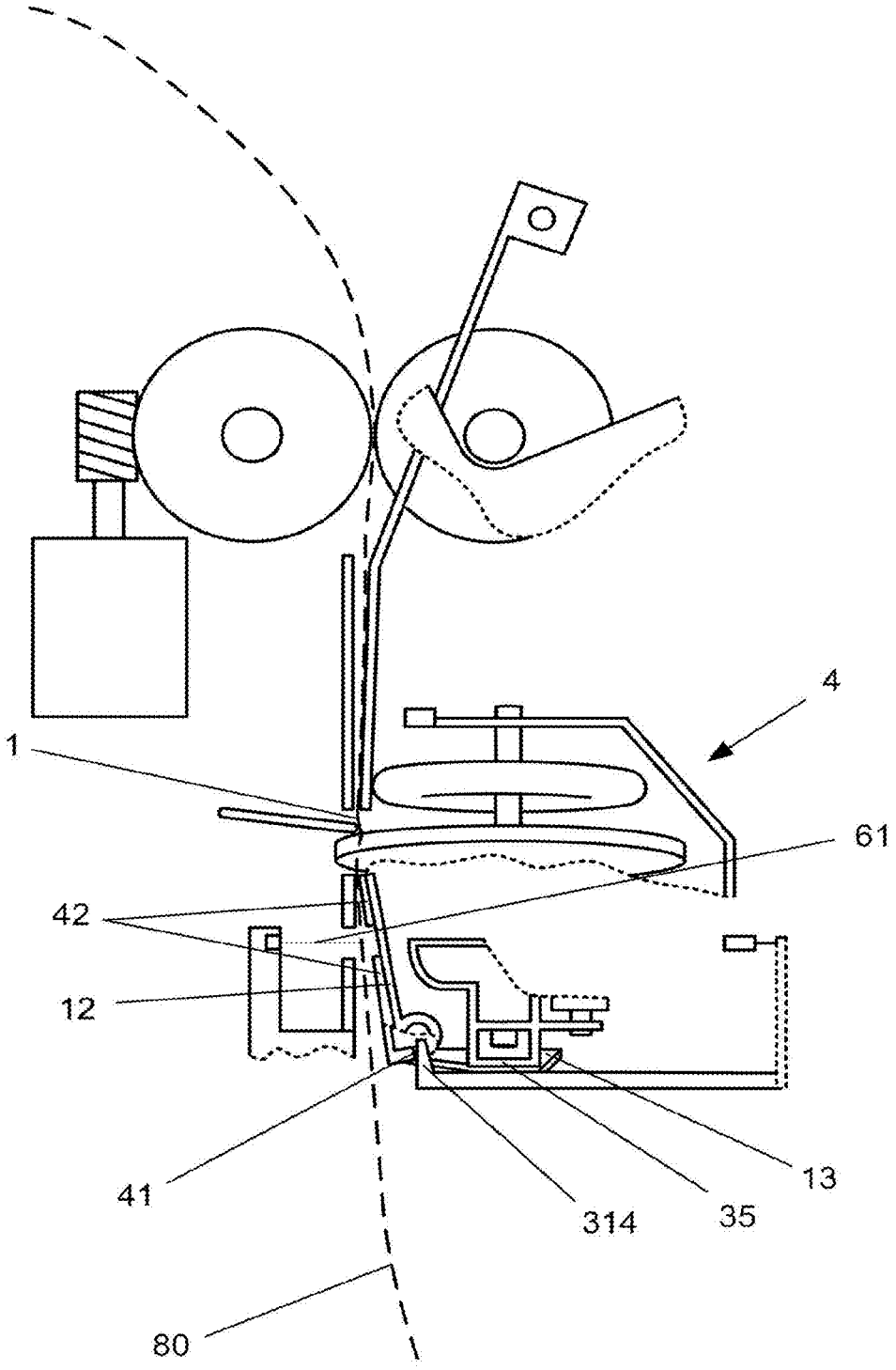
FIG. 9 is a left side view of the invention after the rightward (return) pass of the cutting sequence short of the home position.

FIG. 9 is a left side view of the invention after the rightward (return) pass of the cutting sequence. Even though the paper 1 has been cut completely, the cut portion of the paper 80 is still held by the central portion 42 of the pinch plate 12. This is because once the abutments 314 engage the notch 41, it cannot be released from the abutments 314 until the lower pinch plate release pad 13 on the right end of the lower pinch plate 12 is pressed downward by the lower pinch plate release foot 35 at the bottom of carousel 4. On its rightward travel (into the page) after cutting the cut portion of the paper 80, the electronic circuitry controlling the motion of the carousel 4 does not allow it to travel all the way to its home position as long as the IR beam 61 is stopped by the cut portion of the paper 80.

In addition, and importantly for safety reasons, the electric circuitry provides that if the IR beam 61 is not stopped by paper (at any stage of operation) the cut motor 200 is prevented from performing the cut operation. In practice this means that if an object is inserted into the machine when paper is not present below the cutter blades, accidental cutting cannot occur.

Figure 10:
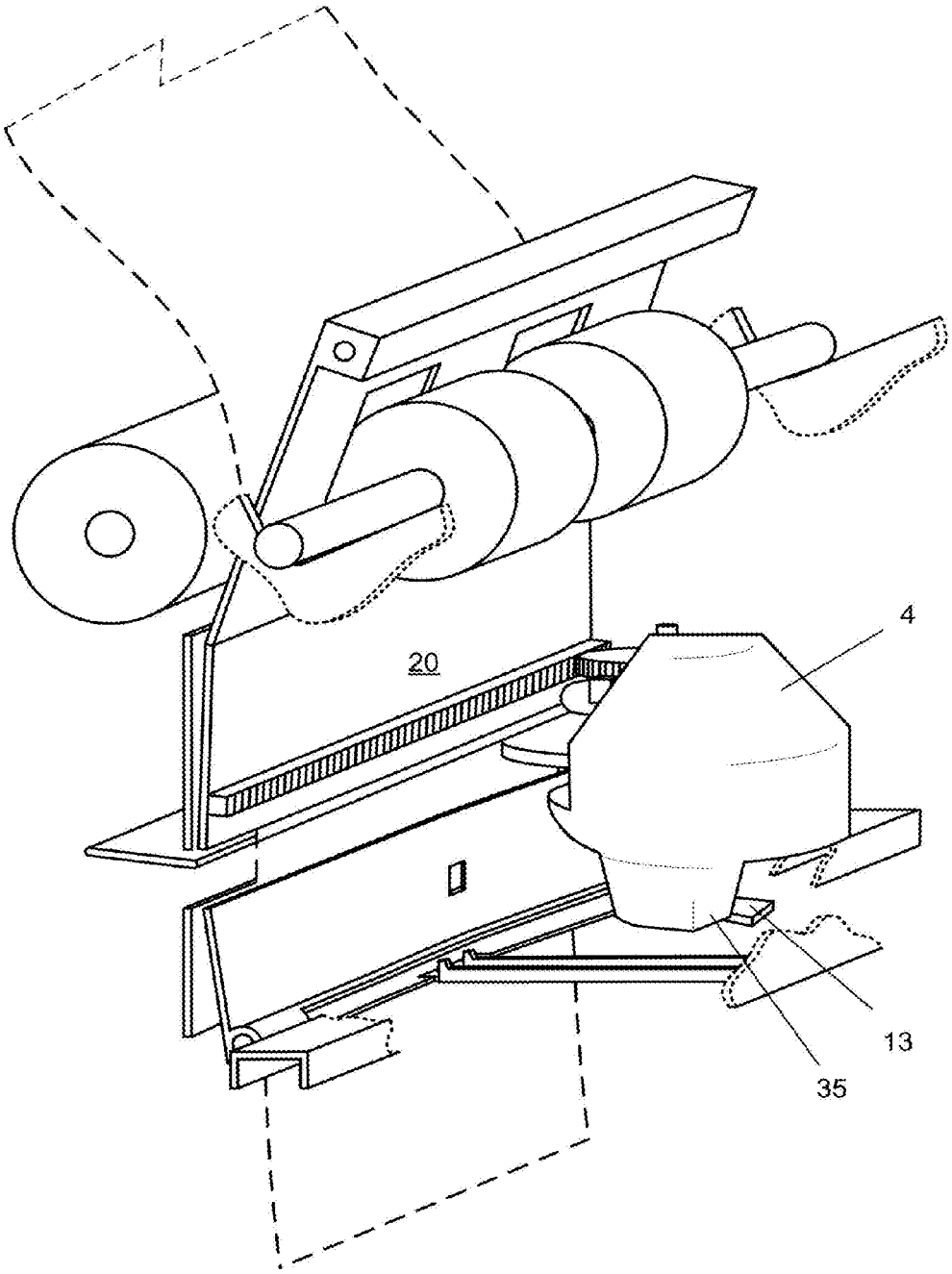
FIG. 10 is a perspective view from the upper left front of the invention in the same state as FIG. 9.

FIG. 10 is a perspective view from the upper left front of the invention in the same state as in FIG. 9, better showing the position of the lower pinch plate release foot 35 of the carousel 4, being stopped just to the left of the lower pinch plate release pad 13.

Figure 11:
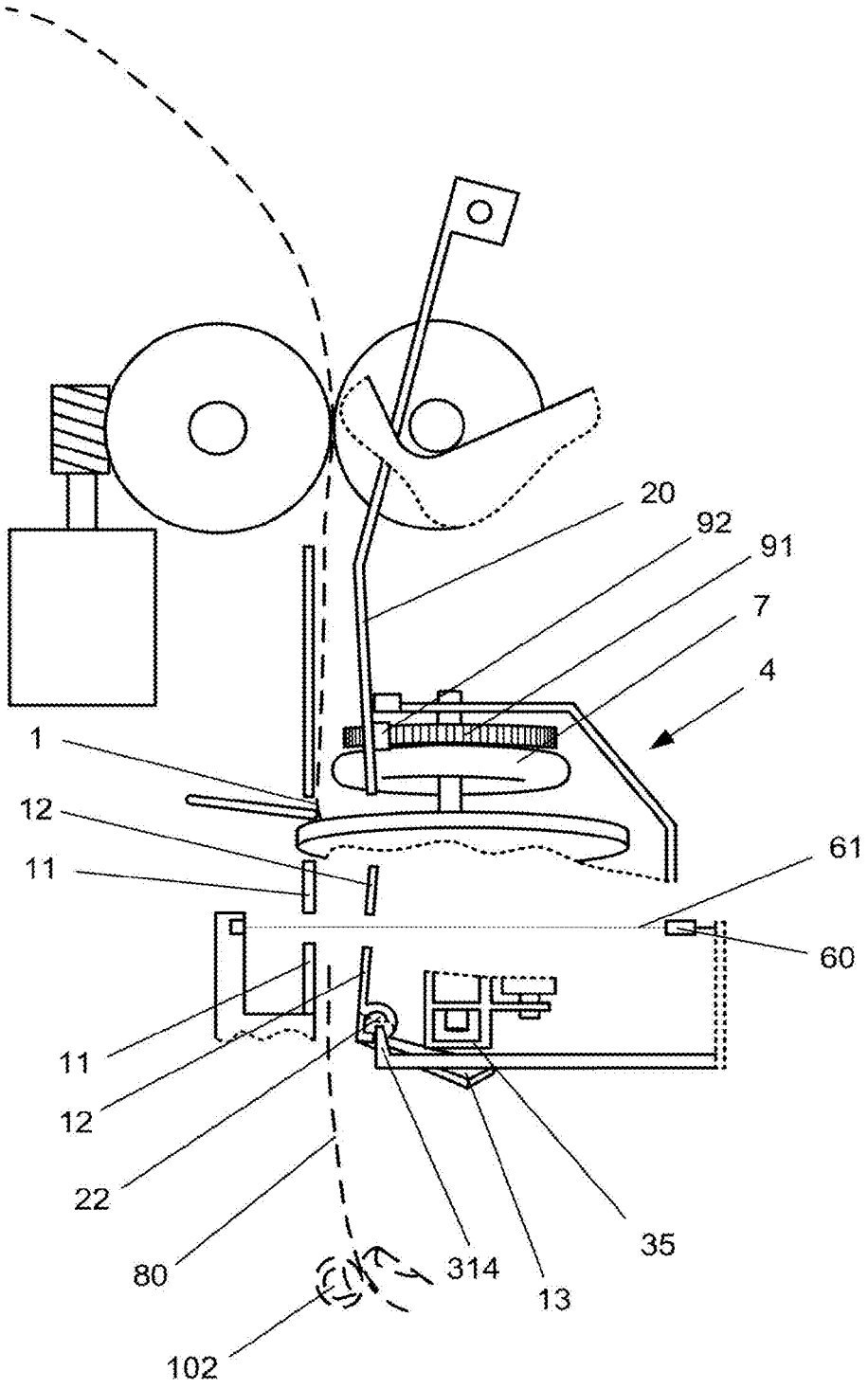
FIG. 11 is a left side view of the invention after cut product is pulled from the invention.

FIG. 11 is a left side view of the invention as the cut portion of the paper 80 is pulled from the invention. In FIGS. 8 and 9, the fully-cut portion of the paper 80 was held gently between only the central portion (not visible in this view) of the lower pinch plate 12 and the lower backing plate 11. In FIG. 11, as soon as the cut portion of the paper 80 is pulled far enough downward by the grasp of a user 102 (shown in large dashed lines to indicate an environmental feature) to allow the IR beam 61 to reach the IR sensor 60, the electronic circuitry causes the carousel 4 to be driven fully to the right (into the page). This causes the lower pinch plate release foot 35 to pass rightward onto the lower pinch plate release pad 13, pressing it down. The lower pinch plate release pad 13, being fixed at its rear end to the lower pinch plate 12, causes the lower pinch plate 12 to rotate clockwise in this view about the lower pinch plate dowel pins 22 (only left pin is visible in this view), thereby causing the lower pinch plate 12 to release all hold on the cut portion of the paper 80. The rubber o-ring 7 (and the optional pinion 91) will also now be out of contact with the upper pinch plate 20 (and, respectively, the optional rack 92) allowing the upper pinch plate 20 to swing forward and release the uncut paper 1 to be rolled downward again when desired by a user.

Figure 12:
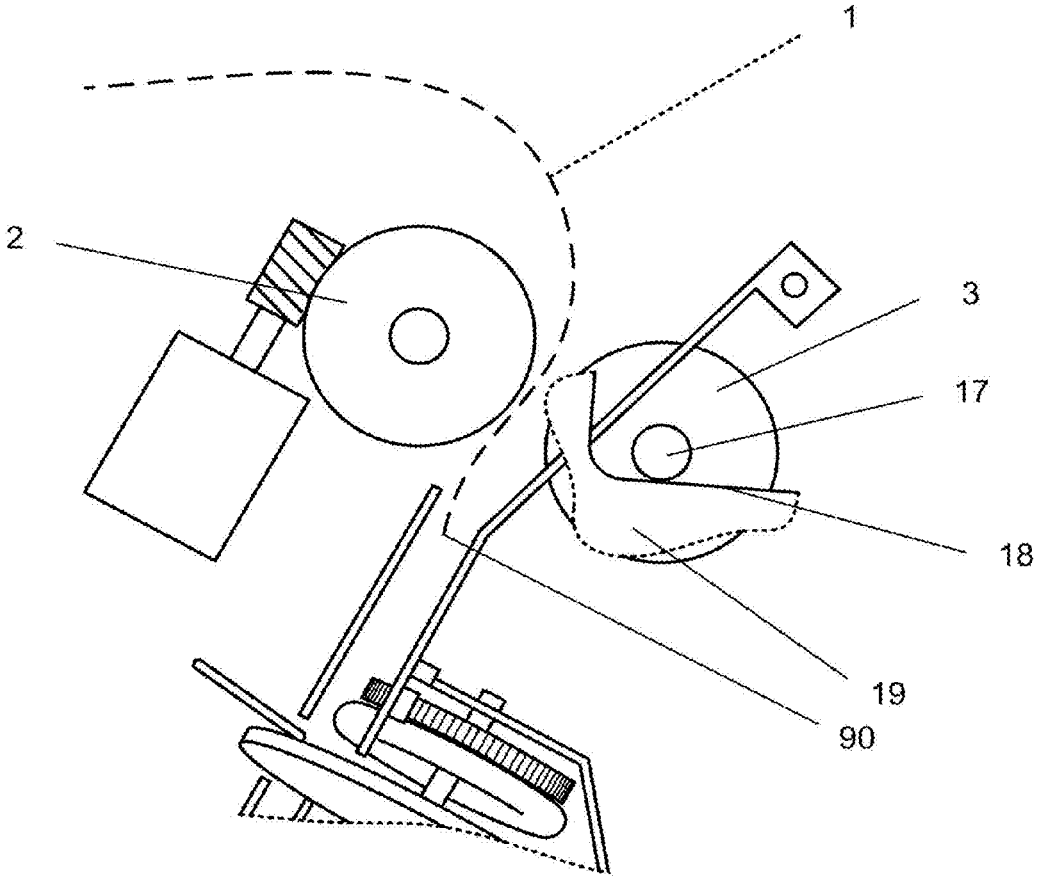
FIG. 12 is a left side view of the invention being tilted fully forward for paper loading.

FIG. 12 is a left side view of the invention being tilted so that its front (to the right in this view) is fully downward for paper loading. Typically, the invention is installed in a cabinet (see, for example, FIG. 14) that supports the stationary parts of the invention on an axis 1414 at the rear and on a latch 180 at the front (see FIG. 18). When the front latch is released, the invention swings downward into the position shown. Note that the amount of forward incline of the invention is now such that the inclines 18 on cutaways of shaft support structures 19 (only the left-hand ones being visible here) are tilted downward toward the front (to the right in this view) thereby allowing the idler rollers 3 and the idler shaft 17 to move forwardly along the incline 18. This creates the opening shown here between the drive roller 2 and the idler rollers 3, allowing the leading end 90 of the paper 1 to be fed manually between them before the cabinet is closed.

Figure 13:
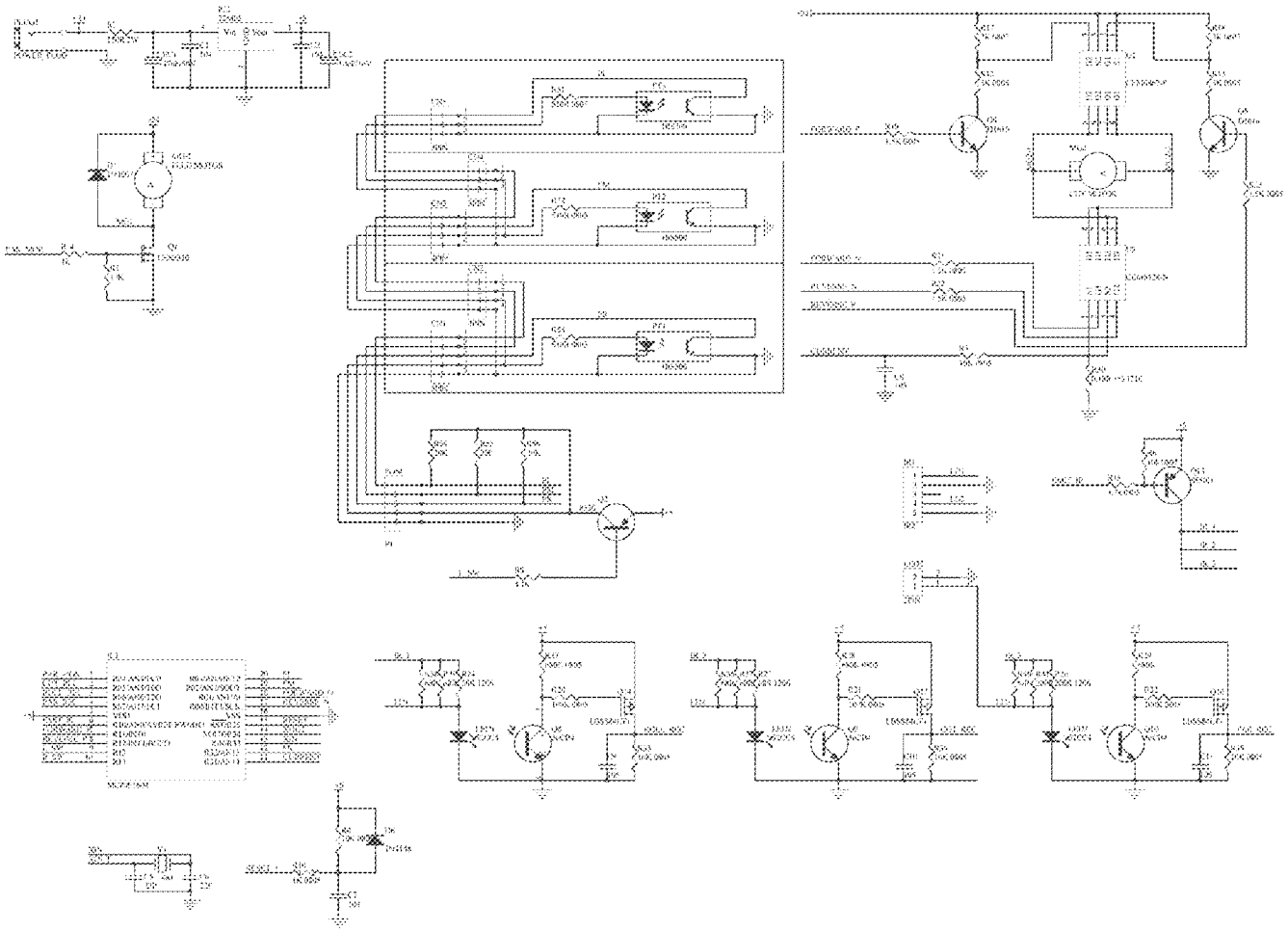
FIG. 13 is a circuit diagram of the first embodiment of the paper cutting and control mechanism of the preferred embodiment.

FIG. 13 is a circuit diagram of the first embodiment of the paper cutting and control mechanism of the preferred embodiment of the present invention. To the greatest extent possible, the electronic circuitry is in the form of printed circuit boards, which are programmable to permit changing, e.g., timing parameters. The circuitry provides that whenever system voltage rises above zero, namely, whenever the cabinet is closed, the carousel is forced to the home position at the far right of the invention as seen from the front. This is important because if the carousel is not fully to the right after the cabinet is opened and re-closed, the rubber o-ring 7 may still be in contact with the upper pinch plate 20 (see FIGS. 5 through 10) which would prevent paper from being fed past the cutting blades.

The circuitry also provides that when the cut cycle is activated, not only does the carousel start moving to the left, but also an electronic timer starts. If the cut motor fails to reach the left side within a predetermined time, power to the cut motor is cut off. This provides added safety in the event motion of the circular paper cutting blade is significantly impeded for any reason.

The present invention also improves the prior art by providing photo (e.g., IR) interrupter switches instead of magnetic or mechanical switches to control starting and stopping of the motors.

Figure 14:
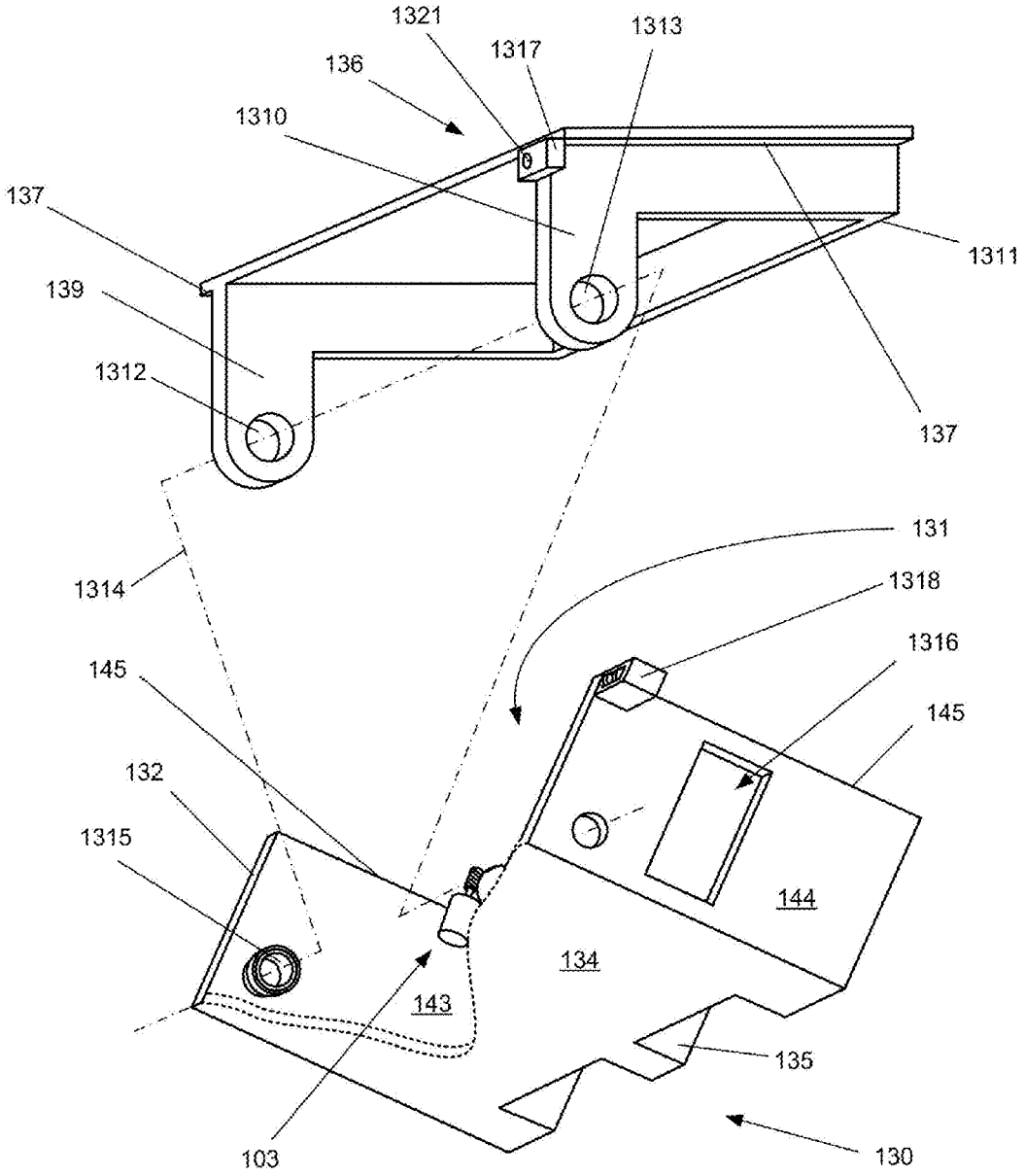
FIG. 14 illustrates an exploded perspective view from the lower left rear of a second embodiment of the invention which includes a cabinet.

FIG. 14 illustrates an exploded perspective view from the lower left rear of a second embodiment of the invention, including a cabinet 130 as mentioned above, wherein the cabinet 130, shown here in a cutaway perspective view, has an open top 131, a rear end 132, right and left sides 143 and 144 respectively, the right and left sides having upper edges 145, a bottom 134, and a front 135, all forming a space into which a module 103 is installed, and comprising additional elements. In this embodiment, the cabinet 130 is rotationally suspended from a bracket 136 having substantially horizontal right and left bracket edges 137, right and left collar supports 139 and 1310 respectively, and a front section 1311. Right and left cylindrical collar holes 1312 and 1313 respectively, which are centered on a common axis 1314, pass through the left and right collar supports 139 and 1310 of the bracket 136.

In this exploded view, the cabinet 130 is shown at an angle such that the plane of the open top 131 is tilted downward toward the front 135 relative to the plane of the substantially horizontal bracket edges 137, to allow insertion of a spirally-wound product roll (not shown) into the cabinet 130. The cabinet 130 tilts downward and upward about the common axis 1314, which is also common to cooperating right and left tube sections (only right tube section 1315 shown in this view) fixed to the right and left sides 143 and 144 respectively of the cabinet 130. The right tube section 1315 has an outside diameter slightly smaller than the inside diameter of the right collar hole 1312 on the bracket 136. The right tube section 1315, inserted within the right collar hole 1312 (as well as the left tube section (not visible in this view) inserted within the left collar hole 1313) forms a special bearing (see ref. 140 in FIG. 17) for gently lowering the cabinet 130 when it is opened, as shown more clearly in FIGS. 16 and 17. The cabinet 130 may be closed by raising the front 135 of the cabinet 130 so that its upper edges 145 are brought into substantial contact with the horizontal bracket edges 137.

FIG. 14 also shows a left side window 1316 in left side 144 which allows a user to see how much spirally-wound product remains inside the cabinet 130. A like window (not shown in this view) may be provided in the right side. Also depicted in FIG. 14 is an important safety power interlock, comprised of an active contact 1317 affixed to the bracket 136, and a passive contact 1318 affixed to the cabinet 130. In this second embodiment, the active contact 1317 receives electric power via an adapter jack 1321.

Figure 15:
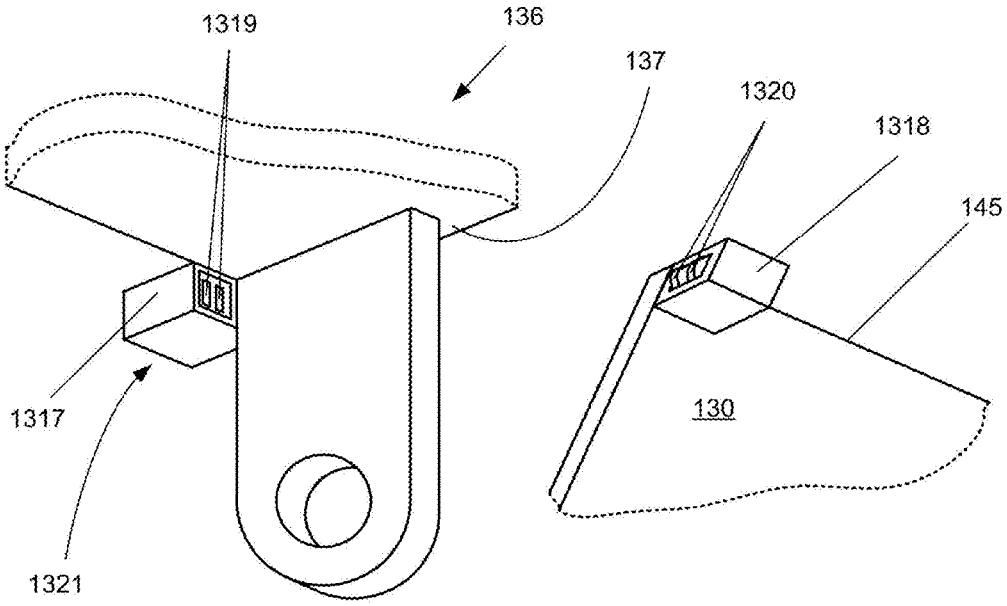
FIG. 15 is a detail perspective view of the power interlock parts of the second embodiment.

FIG. 15 is a detail perspective view of the power interlock parts of the second embodiment. The active contact 1317, shown here attached to the inside of the bracket 136 in cutaway view from the lower left front, has two electrically-conductive active strips 1319 which are constantly charged with direct current (DC) voltage from a DC power adapter (not shown). The DC voltage is applied by a power adapter plug (not shown) through a jack 1321 on the rear side of the active contact 1317 (not visible in this view; see FIG. 14). The passive contact 1318, shown attached to the inside of the cabinet 130, in cutaway view from the lower left rear, has two electrically-conductive passive strips 1320 which come into contact with the active strips 1319 only when the cabinet 130 is raised so that its upper edge 145 is brought into substantial contact with the bottom bracket edge 137.

Figure 16:
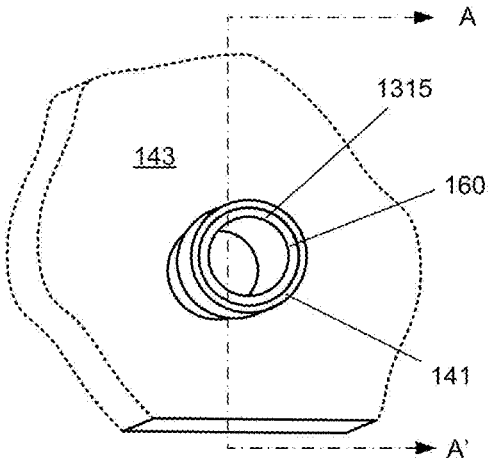
FIG. 16 is detail perspective view of the right tube section of a special bearing of the second embodiment.
Figure 17:
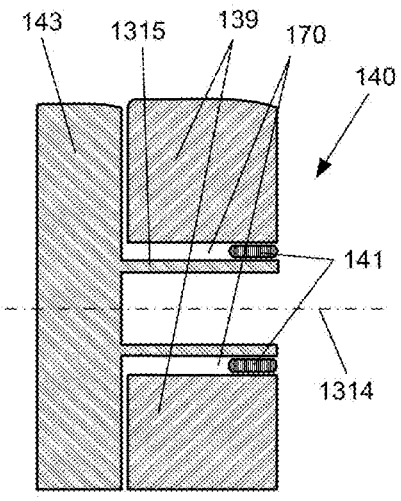
FIG. 17 is a cross-sectional detail of the special bearing of the second embodiment.

FIGS. 16 and 17 illustrate the special bearing 140 of the second embodiment referred to above in FIG. 14. FIG. 16 is an enlarged detail perspective view of the inner, right tube section 1315 portion of the special bearing 140, affixed perpendicularly to the inner surface of a cutaway of the right side 143 of the cabinet 130, as shown in FIG. 14. This figure also better shows a special annular elastic damper 141 stretched around the distal end 160 of the right tube section 1315 portion of the special bearing 140. These parts of the special bearing 140, because they are attached to the cabinet 130 (see FIG. 14), rotate clockwise in this view when the cabinet is opened and counterclockwise when it is closed. FIG. 17 is a cross-sectional view of the entire special bearing 140 along Section A-A' of FIG. 16, including the right collar support 139 of bracket 136 (the rest of which is not visible in this view; see FIG. 14). A mirror image of this special bearing exists in this second embodiment on the left side of the invention. The insertion of the right tube section 1315 into the right collar hole 1312 (see FIG. 14) creates an annular space 170 which, because it is narrower than the original thickness of the elastic damper 141, compresses the elastic damper. The right collar support 139, being part of the bracket 136, does not move, whereas the right tube section 1315 and right cabinet wall 143 rotate about the common axis 1314 when the cabinet 130 (the rest of which is not visible in this view; see FIG. 14) is opened or closed. The elastic damper 141, being slightly compressed between the right tube section 1315 and the right collar hole 1312, yieldingly resists their relative rotation about the common axis 1314. The selection of the shape of the annular space 170, the type of elastic and the degree of interference in the fit determine the amount of torque needed to cause rotation of the right collar hole 1312 about the tube section 1315. A certain shape, elastic material, and interference dimension provide the optimal torque that allow the cabinet 130 to open slowly enough to prevent noise and shock when opened, while not significantly increasing the effort a user must exert to close it. In addition, the second embodiment utilizes springs, as illustrated in the following figure, to provide a counter-torque to stop the opening rotation at a pre-selected point, beyond which the user may further open the cabinet if desired by application of manual downward pressure.

Figure 18:
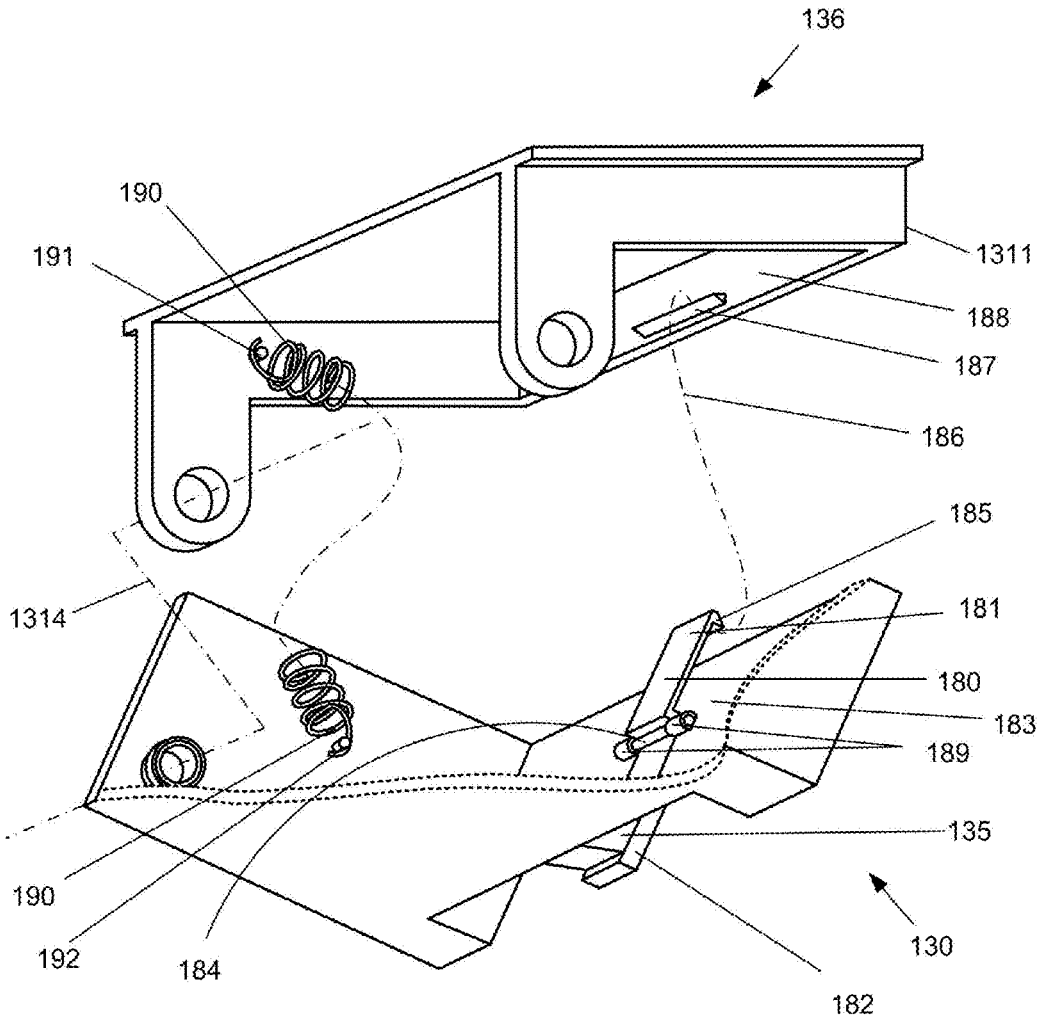
FIG. 18 is an exploded view of the means by which the cabinet of the second embodiment is held in the closed position.

FIG. 18 is an exploded view of this second embodiment from the lower left rear, showing the means by which the cabinet 130, shown here in the open position relative to the bracket 136, may be held in the closed position. A latch paddle 180, having a upper end 181 and a lower end 182, is rotatably attached to the inner surface 183 of the front 135 of the cabinet 130 by an axle 184 affixed to the latch paddle 180 rotating within bearings 189 attached to the cabinet 130. The upper end 181 of the latch paddle 180 is biased forwardly by a spring or other biasing mechanism (not shown) so that the lower end 182 of the latch paddle 180 is as far rearward against the structure of the cabinet 130 as it will go. The upper end 181 of the latch paddle 180 has a forwardly-projecting catch 185, positioned so that when the cabinet 130 is raised to the closed position relative to the bracket 136, the catch 185 follows the general path 186 to releasably engage a striker 187 affixed to the inner surface 188 of the front section 1311 of the bracket 136. The cabinet 130 can be lowered when a user pulls the lower end 182 of the latch paddle 180 forward, at which time the catch 185 is moved rearwardly off the striker 187, allowing the cabinet 130 to swing downwardly under its own weight.

FIG. 18 also shows a helical spring 190 having a bracket end 191 affixed to a point on the right side of the bracket 136 and a cabinet end 192 affixed to a point on the right side of the cabinet 130.

Preferably, in the interest of balancing forces on the cabinet 130 and the special bearings 140, a like spring (not shown) is attached to the opposite points on the left sides of the bracket and cabinet. By proper selection of the coefficient of elasticity of the helical spring 190, a point will be reached by downward travel of the cabinet 130 at which the weight of the cabinet 130 is equaled by the combined tension on the springs 190.

Figure 19:
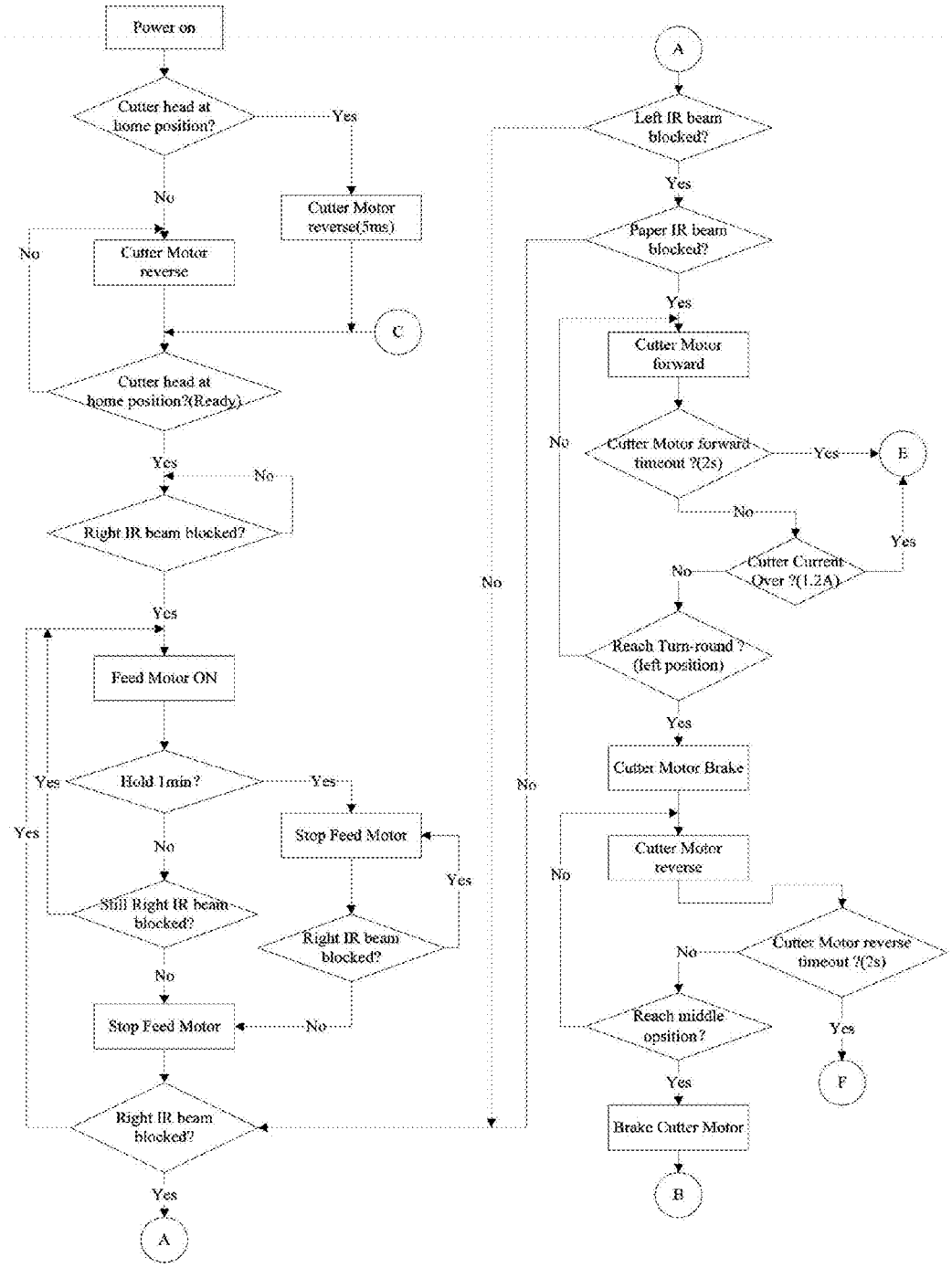
FIG. 19 is the first part of an operational flow diagram of the method performed by the first and second embodiments of the invention.

FIG. 19 is the first part of an operational flow diagram of the detailed method performed by the first and second embodiments of the invention (the second embodiment being the first, preferred embodiment housed in a cabinet with additional inventive elements).

Figure 20:
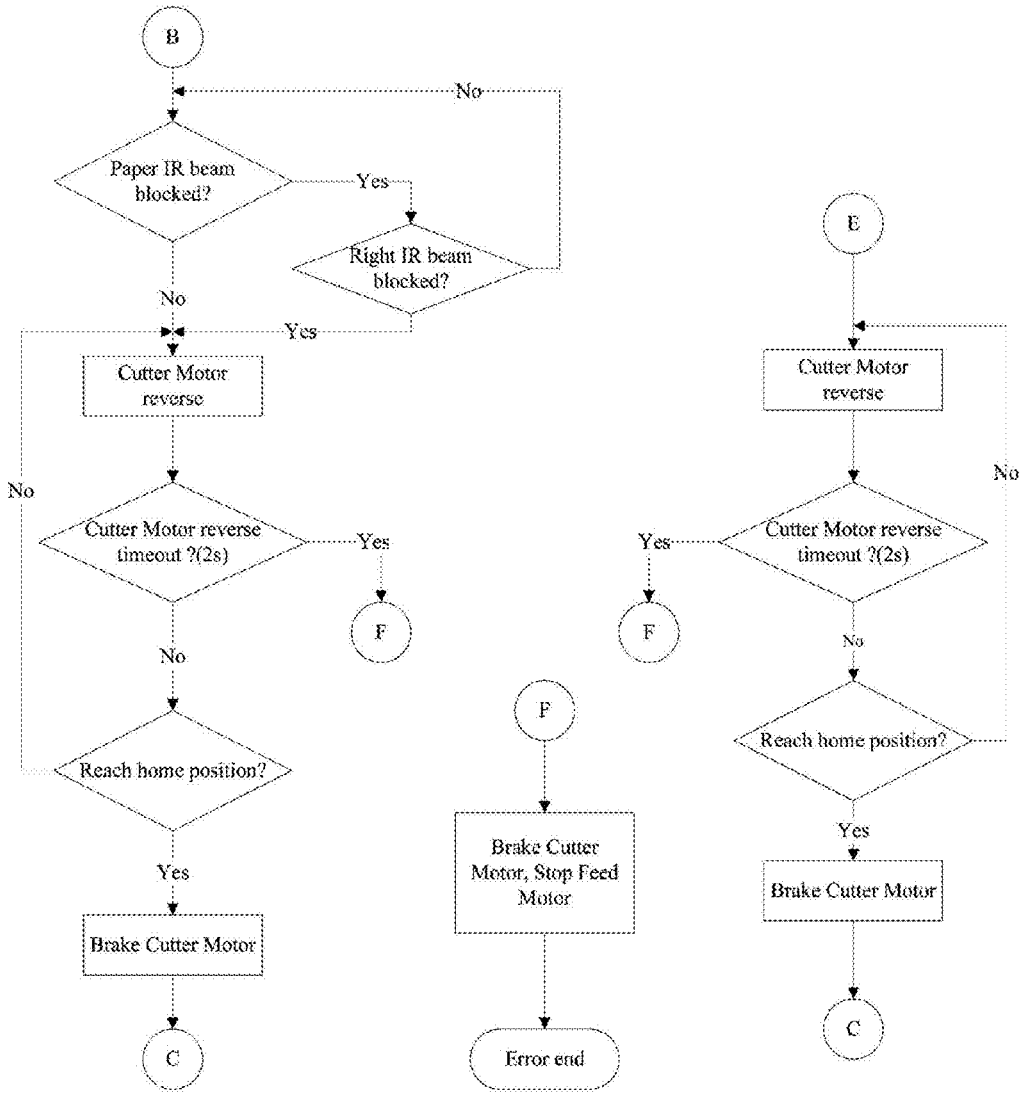
FIG. 20 is the second part of an operational flow diagram of the method performed by the first and second embodiments of the invention.

FIG. 20 is the second part of an operational flow diagram of the method performed by the first and second embodiments of the invention. Portions of this diagram are linked to each other and to portions of FIG. 19 wherever a status circle containing a certain capital letter has output arrows in one portion and input arrows in another. The method described by FIGS. 19 and 20 taken together disclose all of the elements of the method of the first and second embodiments described earlier, plus additional detailed steps relating to precise positioning of the parts and fail-safe characteristics.

Figure 21:
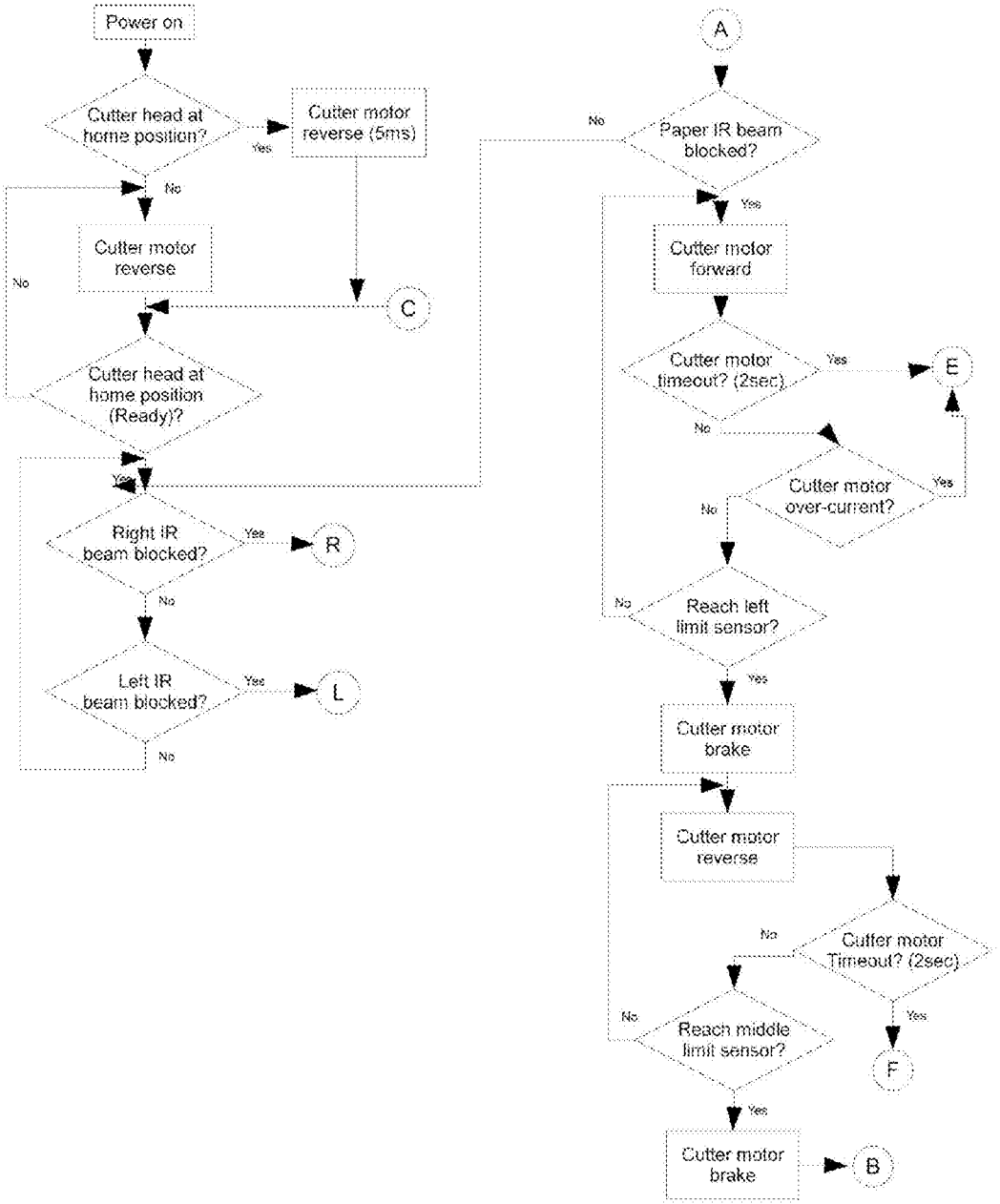
FIG. 21 is the first part of an operational flow diagram of the method performed by a third embodiment of the invention.

FIG. 21 is the first part of an operational flow diagram of the method performed by a third embodiment of the invention, in which the function of the breaking of the left and right electromagnetic beams has been changed from the "dispense on the right" and "cut on the left" mode described above in the first and second embodiments to a "dispense and cut to one length on the right" and "dispense and cut to another length on the left" mode. For example, breaking the right beam can be set to advance the paper to a 6" length and cut it, and breaking the left beam can be set to advance the paper to a 12" length and cut it. Other convenient pairs of lengths may be pre-set depending on the intended use of the invention.

Figure 22:
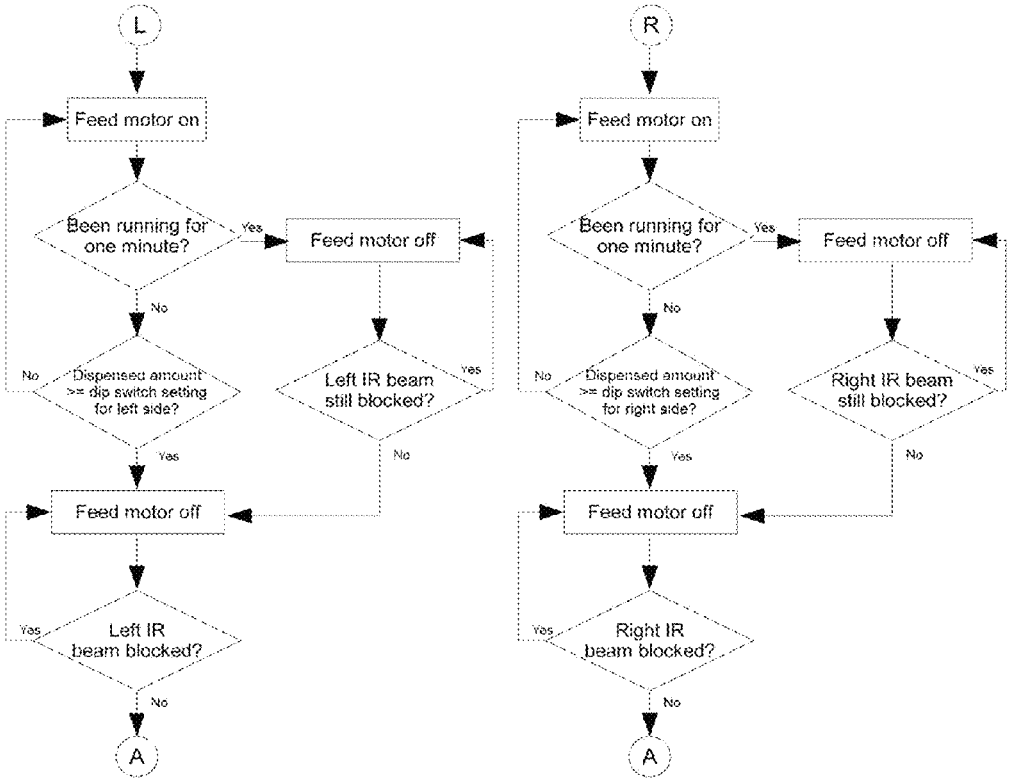
FIG. 22 is the second part of an operational flow diagram of the method performed by a third embodiment of the invention.
Figure 23:
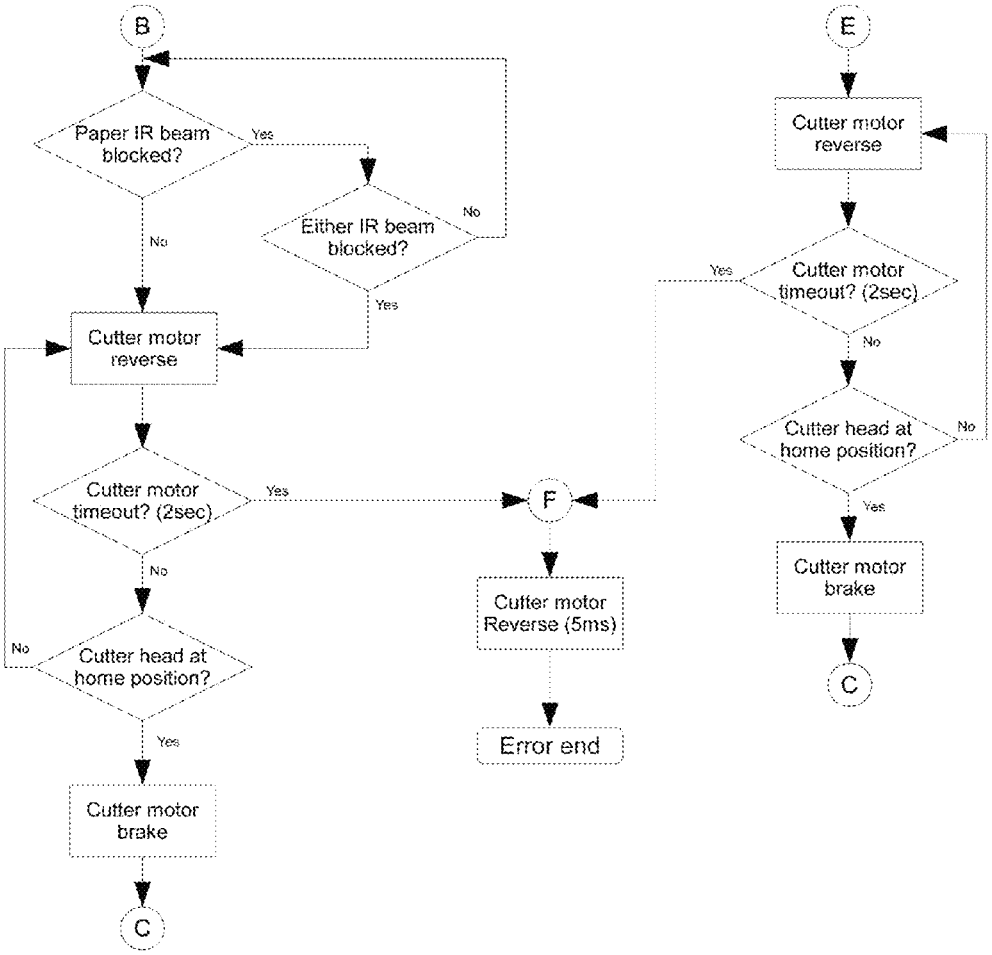
FIG. 23 is the third part of an operational flow diagram of the method performed by a third embodiment of the invention.

As with the flow diagrams of FIGS. 19 and 20, portions of FIG. 21 are linked to each other and to portions of FIGS. 22 and 23 wherever a status circle containing a certain capital letter has output arrows in one portion and input arrows in another.

This third embodiment is physically identical to the first embodiment except for the electronic circuitry driving the moving parts.

FIG. 22 is the second part of the operational flow diagram of the method performed by the third embodiment.

FIG. 23 is the third part of the operational flow diagram of the method performed by the third embodiment. The circuitry can incorporate solely the logic of this embodiment, or, with the addition of a manual switch, can allow a user to change the operation of the hardware from the first embodiment to the third embodiment. The switch may be locked inside the cabinet of the second embodiment so that it may be actuated only by an authorized person.

Figure 24:
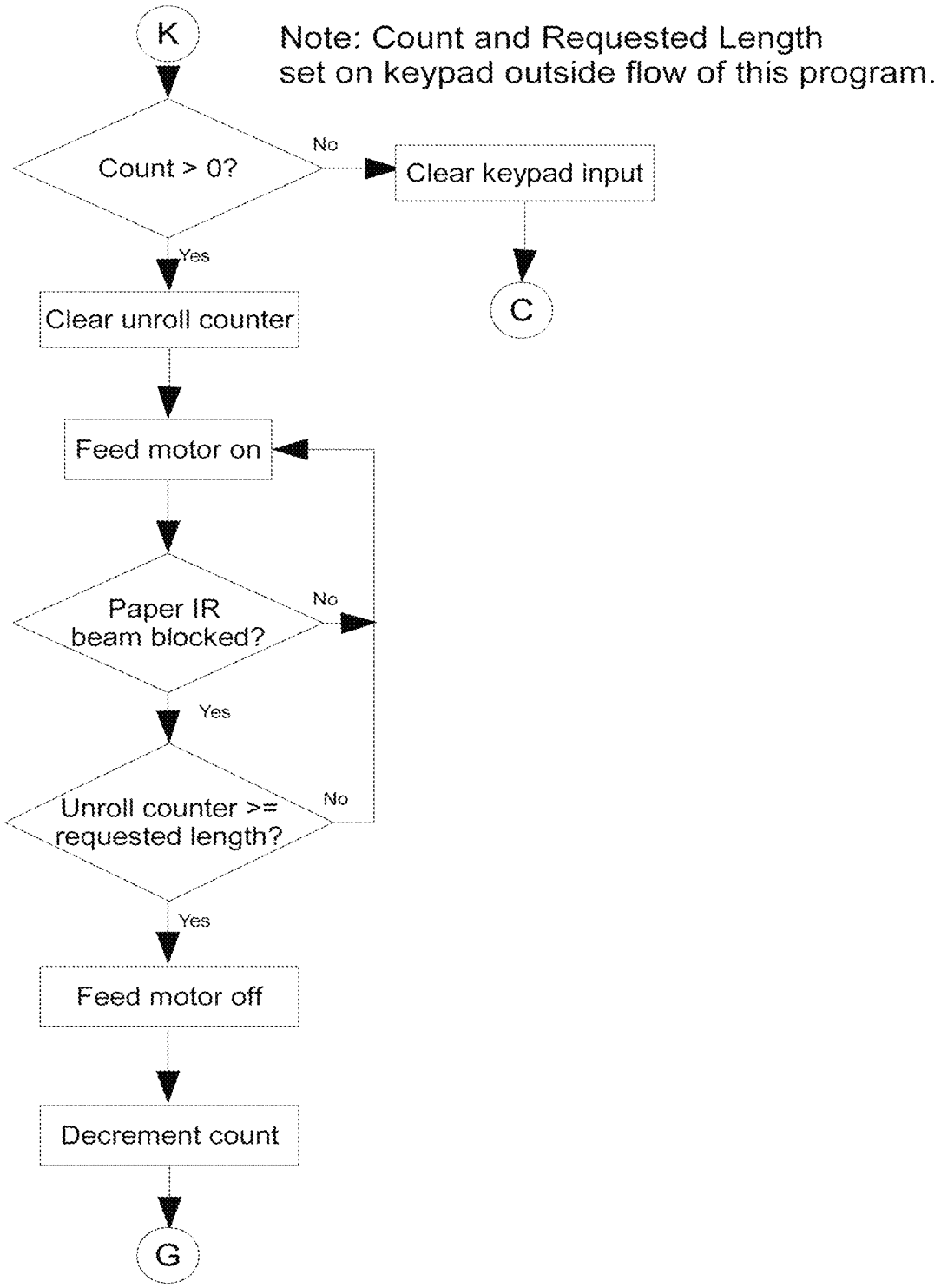
FIG. 24 is the first part an operational flow diagram of the method performed by a fourth embodiment of the invention.

FIG. 24 is the first part an operational flow diagram of the method performed by a fourth embodiment of the invention, in which the circuitry includes a key pad available to the user who may enter a desired length and quantity of sheets. Upon entering these parameters at status circle K in FIG. 24, the machine would begin to dispense and cut until the entered quantity value is satisfied. This can be accomplished in either of two ways: the user can withdraw each sheet as it is cut to release the cutter for the next cut, or the electronic circuitry can be programmed to disable the center LED interlock so that the carousel goes to the home position after each cut, opening the pinch plates and allowing each sheet to drop into a tray. The unit would still be operational in manual mode, that is, as in the first or second embodiments.

Figure 25:
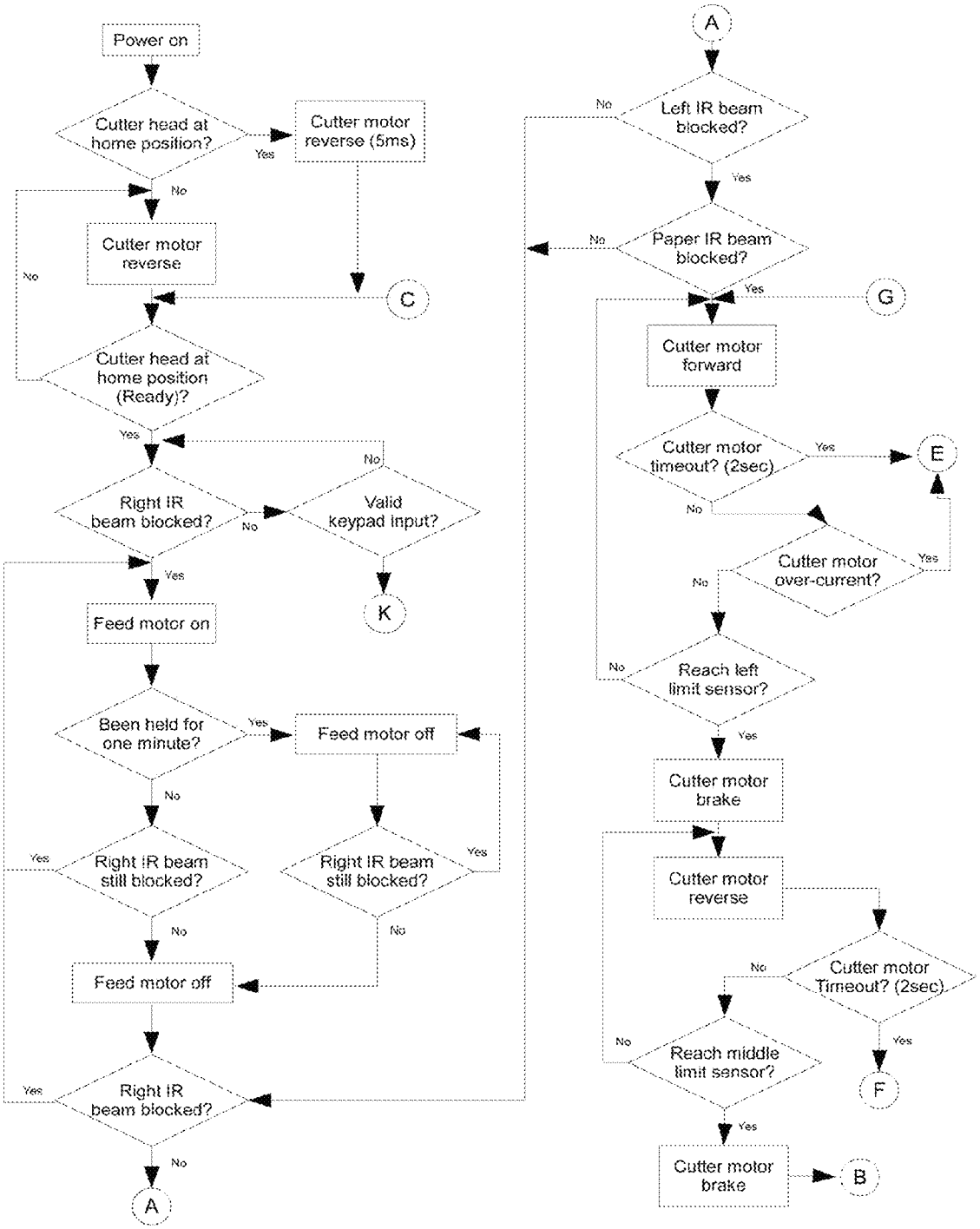
FIG. 25 is the second part an operational flow diagram of the method performed by a fourth embodiment of the invention.
Figure 26:
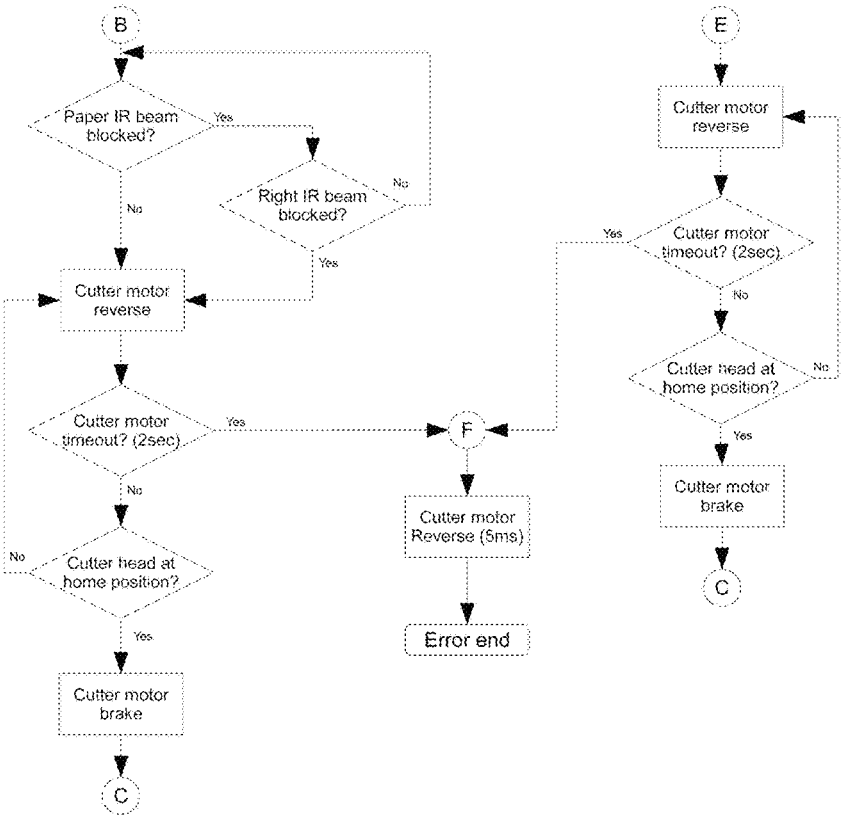
FIG. 26 is the third part of an operational flow diagram of the method performed by a fourth embodiment of the invention.

As with the preceding flow diagrams, portions of FIG. 24 are linked to each other and to portions of FIGS. 25 and 26 wherever a status circle containing a certain capital letter has output arrows in one portion and input arrows in another.

Again, this fourth embodiment is physically identical to the first embodiment except for the electronic circuitry driving the moving parts.

FIG. 25 is the second part the operational flow diagram of the method performed by the fourth embodiment.

FIG. 26 is the third part of the operational flow diagram of the method performed by the fourth embodiment.

Figure 27:
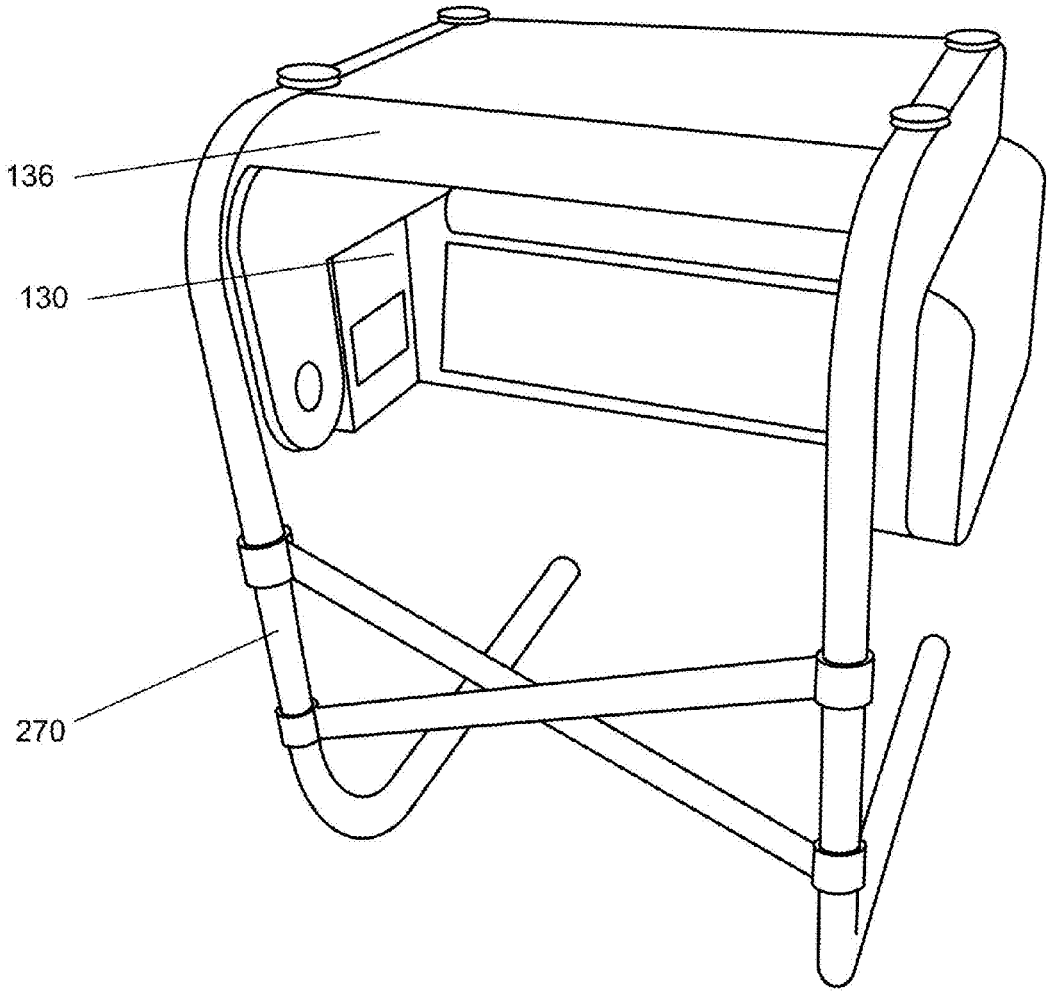
FIG. 27 is a perspective view from the upper left rear of a fourth embodiment of the present invention, which includes a stand for portable applications.

FIG. 27 is a perspective view from the upper left rear of a fourth embodiment of the present invention, which includes a stand 270 for portable applications. The bracket 136 of the second embodiment is installed in the stand 270 and functions the same way. The stand 270 must be sufficiently high that when the cabinet 130 is opened, the bottom of the cabinet 130 does not strike the floor or other surface supporting the stand 270.

The invention claimed is:

1. A dispenser, comprising:

a) a substantially vertical portion of a sheet product within the dispenser;

the vertical portion having a first side facing rearwardly and a second side facing forwardly, defining a right end of the dispenser as being on the right as seen from forward of the vertical portion;

b) a drive roller for driving the vertical portion in a direction of advancement;

the drive roller being supported at its left and right axle ends in bearings fixed in a common support structure;

the drive roller being turned by a drive motor connected rotationally to the drive roller;

c) a cutter assembly for cutting the vertical portion transversely to the direction of advancement along the second side of the vertical portion, driven transversely by a cut motor, having a home position as far to the right as it can go, having a substantially horizontal circular cutting blade, and the cut motor being actuated when the cutter assembly is in the home position and the drive motor is switched from an energized state to a de-energized state;

d) a substantially horizontal, elongate stationary cutting blade having a straight cutting edge mounted proximate to the first side of the vertical portion, e) a means for bringing the circular cutting blade into shearing engagement with the straight cutting edge along substantially the entire length of the straight cutting edge and so as to cut the vertical portion fully transversely in one pass of the cutter assembly;

f) an upper pinching means substantially parallel to the straight cutting edge for releasably pinching the vertical portion above the stationary cutting blade;

g) a lower pinching means substantially parallel to the straight cutting edge for releasably pinching the vertical portion below the stationary cutting blade; comprising a lower pinch plate axle having an axis substantially parallel to the straight cutting edge, and a lower pinch plate extending upwardly from the lower pinch plate axle;

a means for limiting the lateral range of the pinch force applied to the vertical portion to a transverse width less than the full width of the vertical portion; and h) a means for releasing the pinching of the vertical portion when a user removes the cut vertical portion from the lower pinching means; and wherein:

the means for limiting the lateral range of the pinch force applied to the vertical portion by the lower pinch plate to a transverse width less than the full width of the vertical portion comprises the axis of the lower pinch plate axle being positioned a selected distance forward of said straight cutting edge;

the lower pinch plate and the lower pinch plate axle each having a selected flexibility;

a central region approximately halfway between the right end and the left end of the lower pinch plate axle;

the lower pinch plate axle having a notch formed therein;

the notch being located between the left and right ends of the lower pinch plate axle proximate to the central region, and below the axis of the lower pinch plate axle proximate in the forward-backward dimension to a vertical plane through the axis of the lower pinch plate axle;

the notch having a substantially vertical forward-facing face; at least one abutment affixed to the common support structure;

the at least one abutment being located horizontally in the left-right dimension proximate to the central region and having a substantially vertical rearward-facing face; and the rearward-facing face being located horizontally proximate in the forward-rearward dimension to a vertical plane through the lower pinch plate axis.

2. The dispenser of claim 1, wherein:

said means for sending the cutter assembly to the home position when the vertical portion is removed from the dispenser comprises means for sensing the absence of said vertical portion between said lower pinch plate and said lower backing plate.

3. The dispenser of claim 2, in which:

said means for sensing the absence of said vertical portion between said lower pinch plate and said lower backing plate comprises an electromagnetic beam passing between the lower pinch plate and said lower backing plate.

4. The dispenser of claim 1, in which:

said straight cutting edge is inclined downwardly from the horizontal in the forward direction at an angle of between 3 degrees and 7 degrees; and the plane of said circular cutting blade is included in the direction of motion during cutting at an angle of between 3 degrees and 7 degrees from the horizontal.

5. The dispenser of claim 1, comprising:

an elongate cutter assembly guide rail approximately parallel to said stationary cutting blade;

means for restricting the left-right path of said cutter assembly to the guide rail; and means for biasing the guide rail in a rearward direction.

6. The dispenser of claim 1, in which:

said common support structure is a cabinet rotatably mounted in a mounting bracket on a transverse axis upon which said cabinet opens downwardly in the forward direction to an open position for loading a roll of spirally-wound sheet product, and upwardly to a closed position for dispensing;

the open position being at a first downward angle relative to the horizontal;

said idler support inclines are at a second downward angle relative to the horizontal when said cabinet is in the closed position;

the second downward angle relative to the horizontal being less than the first downward angle relative to the horizontal.

7. The dispenser of claim 6, in which:

said cabinet is rotatably mounted in said mounting bracket by identical left and right special bearings;

each special bearing comprising a first tube section having an outer diameter, and a second tube section coaxial to the first tube section having an inner diameter larger than the outer diameter of the first tube section, the first tube section being mounted within the second tube section;

an annular elastic damper that, when placed around the first tube section, has a rectangular cross-section of a thickness greater than one-half the difference between the outer diameter and the inner diameter so that it is compressed between the first tube section and the second tube section; and the attachment of the first tube section and the second tube section to said cabinet and said mounting bracket is taken from the list of:

a) the first tube section of the left special bearing is affixed to the left side of said cabinet, the first tube section of the right special bearing is affixed to the right side of said cabinet, the second tube section of the left special bearing is affixed to the left side of said mounting bracket, and the second tube section of the right special bearing is affixed to the right side of said mounting bracket; and b) the first tube section of the left special bearing is affixed to the left side of said mounting bracket, the first tube section of the right special bearing is affixed to the right side of said mounting bracket, the second tube section of the left special bearing is affixed to the left side of said cabinet, and the second tube section of the right special bearing is affixed to the right side of said cabinet.

* * * * *